US010494173B2

(12) United States Patent
Sheppard et al.

(10) Patent No.: US 10,494,173 B2
(45) Date of Patent: Dec. 3, 2019

(54) SEED STORAGE AND DISPENSING BIN

(71) Applicant: Harvey Milling Co., Inc., Carson City, MI (US)

(72) Inventors: Jim Sheppard, Greenville, MI (US); Robert Bollinger, Carson City, MI (US); Grady McCrackin, Carson City, MI (US)

(73) Assignee: Harvey Milling Co., Inc., Carson City, MI (US)

( * ) Notice: Subject to any disclaimer, the term of this patent is extended or adjusted under 35 U.S.C. 154(b) by 81 days.

(21) Appl. No.: 15/454,563

(22) Filed: Mar. 9, 2017

(65) Prior Publication Data

US 2017/0267449 A1 Sep. 21, 2017

Related U.S. Application Data

(60) Provisional application No. 62/425,244, filed on Nov. 22, 2016, provisional application No. 62/308,556, filed on Mar. 15, 2016.

(51) Int. Cl.

| | |
|---|---|
| ***B65D 90/62*** | (2006.01) |
| ***B65D 88/30*** | (2006.01) |
| ***B65D 88/12*** | (2006.01) |
| ***B65D 90/12*** | (2006.01) |

(52) U.S. Cl.

CPC ..... *B65D 90/626* (2013.01); *B65D 88/126* (2013.01); *B65D 88/30* (2013.01); *B65D 90/12* (2013.01)

(58) Field of Classification Search

CPC ..... B65D 88/26–32; B65D 88/122; B65D 88/124; B65D 88/126; B65D 90/12; B65D 90/62–623; B65D 90/58–60

See application file for complete search history.

(56) References Cited

U.S. PATENT DOCUMENTS 1,164,195 A * 12/1915 Kendall ..... B65D 90/582 222/505
1,526,527 A * 2/1925 Butler ..... B65D 88/30 220/7
1,536,874 A * 5/1925 Bates ..... B65D 90/587 251/129.2
1,542,380 A * 6/1925 Foster ..... B65D 88/32 414/267

(Continued)

*Primary Examiner* — Paul R Durand
*Assistant Examiner* — Randall A Gruby
(74) *Attorney, Agent, or Firm* — Barnes & Thornburg LLP

(57) ABSTRACT

A seed storage and dispensing bin includes a walled container having a top, a bottom opposite the top, an interior space defined between the top and the bottom and a divider dividing the interior space into first and second separate spaces each sized to receive a plurality of seeds therein. First and second openings are defined in the walled container at or near the bottom thereof, with each opening to a respective one of the first and second spaces. First and second doors are mounted to the container over the first and second openings respectively. Means are provided for moving the first door between open and closed positions thereof, and for moving the second door between open and closed positions thereof. In some embodiments, the same or different cross-sectional areas of the first and second openings may be exposed through selective movement of the first and second doors respectively.

16 Claims, 16 Drawing Sheets

(56) References Cited

U.S. PATENT DOCUMENTS 1,649,286 A * 11/1927 Bupnett ..... B65D 90/582 110/171
1,688,600 A * 10/1928 Slifer ..... B65D 90/587 193/17
1,720,176 A * 7/1929 Gottschall ..... B65D 90/587 193/21
1,907,773 A * 5/1933 Fisher ..... B65D 90/582 193/21
2,299,702 A * 10/1942 Mosel ..... B65D 88/30 220/553
2,374,398 A * 4/1945 Wagner ..... B60P 3/16 298/8 R
2,782,011 A * 2/1957 Fitzgerald ..... B65D 88/68 222/145.6
3,038,566 A * 6/1962 Parsons ..... B65D 88/32 52/194
3,100,456 A * 8/1963 Dorey ..... B61D 7/20 105/253
3,125,254 A * 3/1964 Schuette, Jr. ..... B65D 90/623 222/129
3,397,654 A * 8/1968 Snyder ..... B61D 7/20 105/305
3,441,224 A * 4/1969 Barth ..... A01C 17/00 239/656
3,497,109 A * 2/1970 Leach ..... A01K 39/01 119/56.1
3,581,870 A * 6/1971 Best ..... B21D 43/006 198/531
3,904,105 A * 9/1975 Booth ..... B65D 5/12 206/386
4,027,787 A * 6/1977 Bibeau ..... B65D 88/56 222/166
4,243,158 A * 1/1981 Negosta ..... A47K 5/10 222/184
4,266,691 A * 5/1981 Wolwowicz ..... G01G 13/08 141/128
4,290,352 A * 9/1981 Schmidt ..... B30B 9/3046 100/100
4,437,798 A * 3/1984 Schipper ..... B65G 53/46 105/287
4,453,645 A * 6/1984 Usui ..... B65D 88/26 220/530
4,523,690 A * 6/1985 Cornelius ..... A01D 90/12 220/262
4,545,523 A * 10/1985 Galbreath ..... B65D 88/126 220/908
4,609,151 A * 9/1986 Crowley ..... A01C 15/005 222/136
4,646,942 A * 3/1987 Kuhns ..... B65D 90/587 220/262
4,747,244 A * 5/1988 Christianson ..... B65D 90/10 220/262
5,199,612 A * 4/1993 Raque ..... A21C 9/04 105/280
5,205,695 A * 4/1993 Katsui ..... F23G 5/444 222/129
5,218,784 A * 6/1993 Pollock ..... B65D 90/10 220/264
5,275,129 A * 1/1994 Vigesaa ..... A01K 5/0291 119/51.11
5,339,996 A * 8/1994 Dubbert ..... B28C 7/0046 182/186.6
6,401,983 B1 * 6/2002 McDonald ..... B60P 1/56 220/1.5
7,350,872 B2 * 4/2008 Wood ..... B60P 1/283 298/18
7,921,783 B2 * 4/2011 Forbes ..... B61D 7/02 105/247
8,083,083 B1 * 12/2011 Mohns ..... B65D 88/32 220/1.5
9,919,867 B1 * 3/2018 Poncsak ..... B65D 90/66
2005/0076843 A1 * 4/2005 Ansaldo ..... A01K 5/0225 119/57.91
2005/0198902 A1 * 9/2005 Meyer ..... B65D 90/587 49/279
2008/0029546 A1 * 2/2008 Schuld ..... B65D 88/26 222/185.1
2013/0295833 A1 * 11/2013 Thiessen ..... B65D 88/745 454/178
2014/0083554 A1 * 3/2014 Harris ..... B65D 88/32 141/1
2015/0291348 A1 * 10/2015 Lopez ..... B65D 88/027 220/1.5
2018/0194552 A1 * 7/2018 Lucas ..... B65D 90/582

* cited by examiner

SEED STORAGE AND DISPENSING BIN

CROSS-REFERENCE TO RELATED APPLICATION

This patent application claims the benefit of, and priority to, U.S. Provisional Patent Application Ser. No. 62/425,244, filed Nov. 22, 2016, and to U.S. Provisional Patent Application Ser. No. 62/308,556, filed Mar. 15, 2016, the disclosures of which are both incorporated herein by reference.

FIELD OF THE INVENTION

The present invention relates generally to storage and dispensing bins, and more specifically to seed storage and dispensing bins.

BACKGROUND

Agricultural seeds are conventionally stored in multiple bags prior to planting. In cases where different types or varieties of seeds are mixed together for planting, such mixing is typically accomplished by manually combining together part or all of the contents of two or more such bags of different seed types or varietals. A need accordingly exists for advancements in seed storage and dispensing.

SUMMARY

The present invention may comprise one or more of the features recited in the attached claims, and/or one or more of the following features and combinations thereof. In one aspect, a seed storage and dispensing bin may comprise a walled container having a top, a bottom opposite the top, an interior space defined between the top and the bottom and a divider dividing the interior space into first and second separate spaces each sized to receive a plurality of seeds therein, a first opening defined in the bottom of the container and open to the first space, a second opening defined in the bottom of the container and open to the second space, a first door mounted to the container over the first opening, a second door mounted to the container over the second opening, means for moving the first door between a closed position in which the first door covers the first opening and an open position in which a first cross-sectional area of the first opening is exposed, and means for moving the second door between a closed position in which the second door covers the second opening and an open position in which a first cross-sectional area of the second opening is exposed. In some embodiments, the same or different cross-sectional areas of the first and second openings can be exposed through selective movement of the first and second doors respectively.

In another aspect, a seed storage and dispensing bin may comprise a walled container having a top, a bottom opposite the top, and an interior space defined between the top and the bottom and sized to receive a plurality of seeds therein, a roof having an open bottom and a top opposite the open bottom thereof, the bottom of the roof coupled to the top of the walled container and the top of the roof defining an opening therethrough, and an elongated ladder or seed slide assembly positioned in the interior space of the walled container and coupled at or near a top end thereof to the roof at or near the opening defined through the roof, the elongated ladder or seed slide assembly having a bottom end, opposite the top end thereof, extending downwardly into the interior space of the walled container, the elongated ladder or seed slide assembly transporting seeds released at or near the opening in the top of the roof downwardly into the interior space of the walled container.

In yet another aspect, a seed storage and dispensing bin may comprise a walled container having a top, a bottom opposite the top, an interior space defined between the top and the bottom and a divider dividing the interior space into first and second separate spaces each sized to receive a plurality of seeds therein, a first opening defined in the bottom of the container and open to the first space, a second opening defined in the bottom of the container and open to the second space, a first door mounted to the container over the first opening, a second door mounted to the container over the second opening, a first actuator configured to move the first door between a closed position in which the first door completely covers the first opening and a fully open position in which a first cross-sectional area of the first opening is exposed, and a second actuator configured to move the second door between a closed position in which the second door completely covers the second opening and a fully open position in which a first cross-sectional area of the second opening is exposed, whereby the first and second actuators are selectively actuatable to expose the same or different cross-sectional areas of the first and second openings respectively.

BRIEF DESCRIPTION OF THE DRAWINGS

This disclosure is illustrated by way of example and not by way of limitation in the accompanying Figures. Where considered appropriate, reference labels have been repeated among the Figures to indicate corresponding or analogous elements.

DETAILED DESCRIPTION OF THE DRAWINGS

Figure 1:
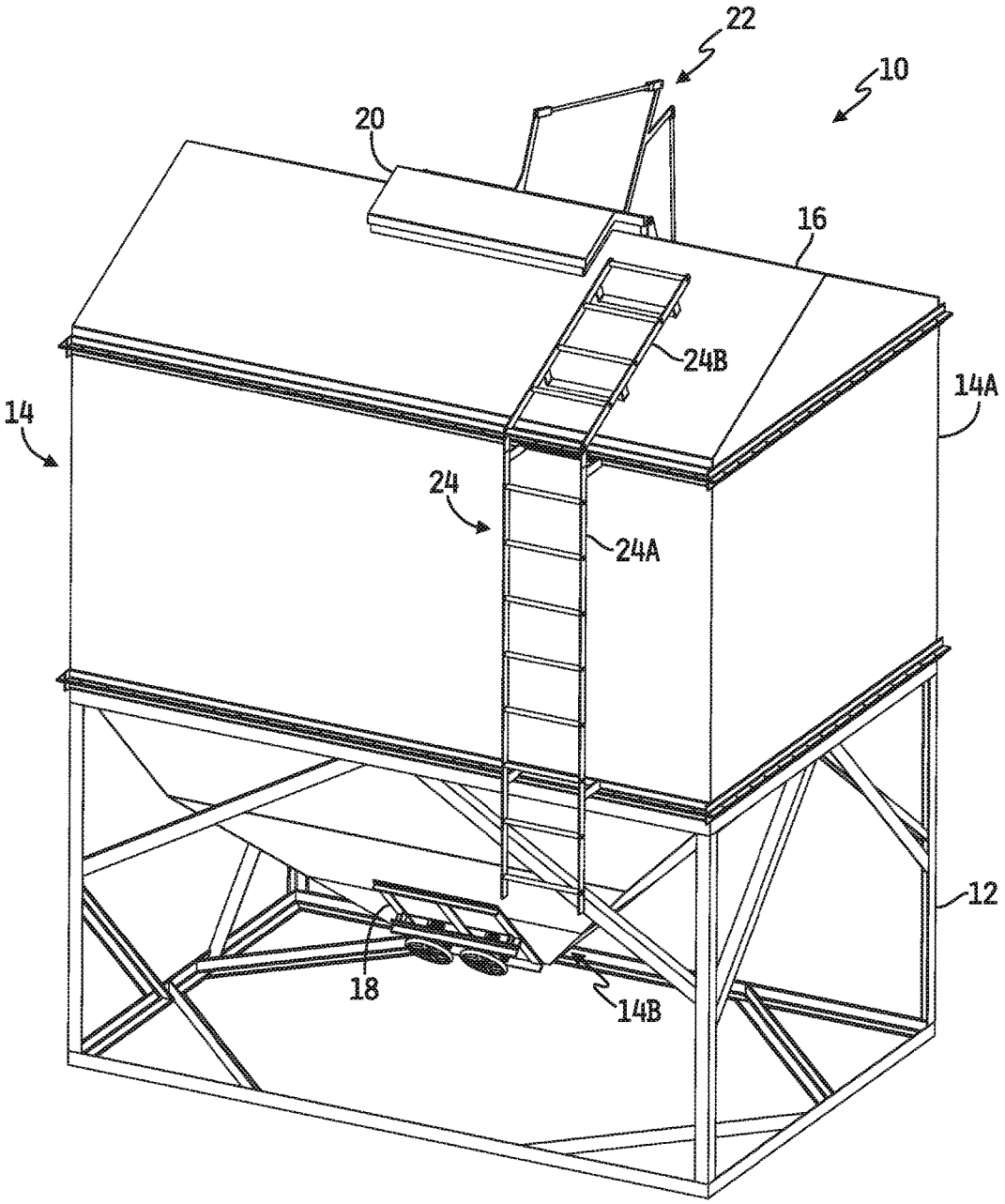
FIG. 1 is a front perspective view of an embodiment of a seed storage and dispensing bin.

While the concepts of the present disclosure are susceptible to various modifications and alternative forms, specific exemplary embodiments thereof have been shown by way of example in the drawing and will herein be described in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases may or may not necessarily refer to the same embodiment. Further, when a particular feature, structure or characteristic is described in connection with an embodiment, it is submitted that it is within the knowledge of one skilled in the art to effect such feature, structure or characteristic in connection with other embodiments whether or not explicitly described. Further still, it is contemplated that any single feature, structure or characteristic disclosed herein may be combined with any one or more other disclosed feature, structure or characteristic, whether or not explicitly described, and that no limitations on the types and/or number of such combinations should therefore be inferred.

Referring now to FIGS. 1-8, an embodiment is shown of a seed storage and dispensing bin 10. In the illustrated embodiment, the seed storage and dispensing bin 10 is illustratively portable and may be transported to a desired location and/or from one location to another, and/or assembled, partially or wholly, in the field. In any case, the seed storage and dispensing bin 10 is configured to receive, store therein and selectively dispense one or more types or varieties of seeds.

In the illustrated embodiment, the bin 10 includes a frame 12 having an open top end 12A configured to receive therein a bottom of a walled container 14, and a bottom end 12B configured to be supported on a support surface 15, e.g., the earth or other structure or material(s) supported by the earth. A roof 16 is fitted onto a top of the walled container 14.

The walled container 14 illustratively includes an upper walled enclosure 14A having an open top 40 and an open bottom 42 opposite the open top 40, and a lower walled enclosure 14B having an open top 50 and a bottom end 52 opposite the open top 50. As will be described in greater detail below, the open bottom 42 of the upper walled enclosure 14A is mounted to the open top 50 of the lower walled enclosure 14B to form the walled container 14. The lower walled enclosure 14B is received within the frame 12 such that the top 50 of the lower walled enclosure 14B is supported by the open top end 12A of the frame 12 with the bottom end 52 of the lower walled enclosure 14B extending downwardly into the frame 12 and suspended just above the support bottom end 12B thereof. In the illustrated embodiment, for example, a flange or rim 51 extends outwardly and away from the walled enclosure 14B and surrounding the open top 50 thereof, and the flange 51 comes into contact with, and is supported by, the top end 12A of the frame 12 when the walled enclosure 14B is received within the frame 12. In any case, such a configuration illustratively provides for stability of the seed storage and dispensing bin 10 as a substantial portion of the weight of seeds contained within the bin 10 is distributed below the top 12A of the frame 12 and therefore contained within the frame 12.

Figure 2:
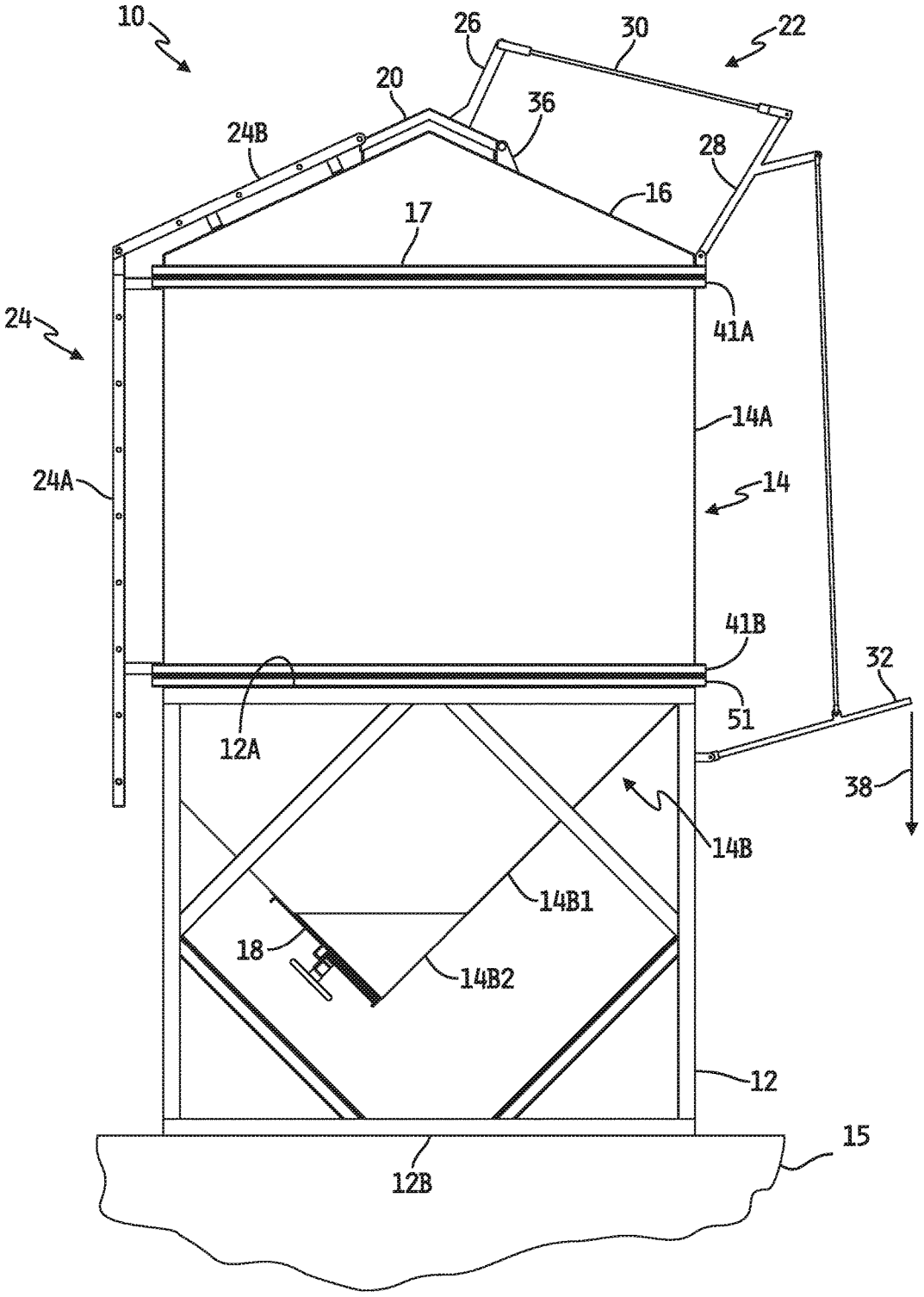
FIG. 2 is a side elevational view of the seed storage and dispensing bin illustrated in FIG. 1.
Figure 3:
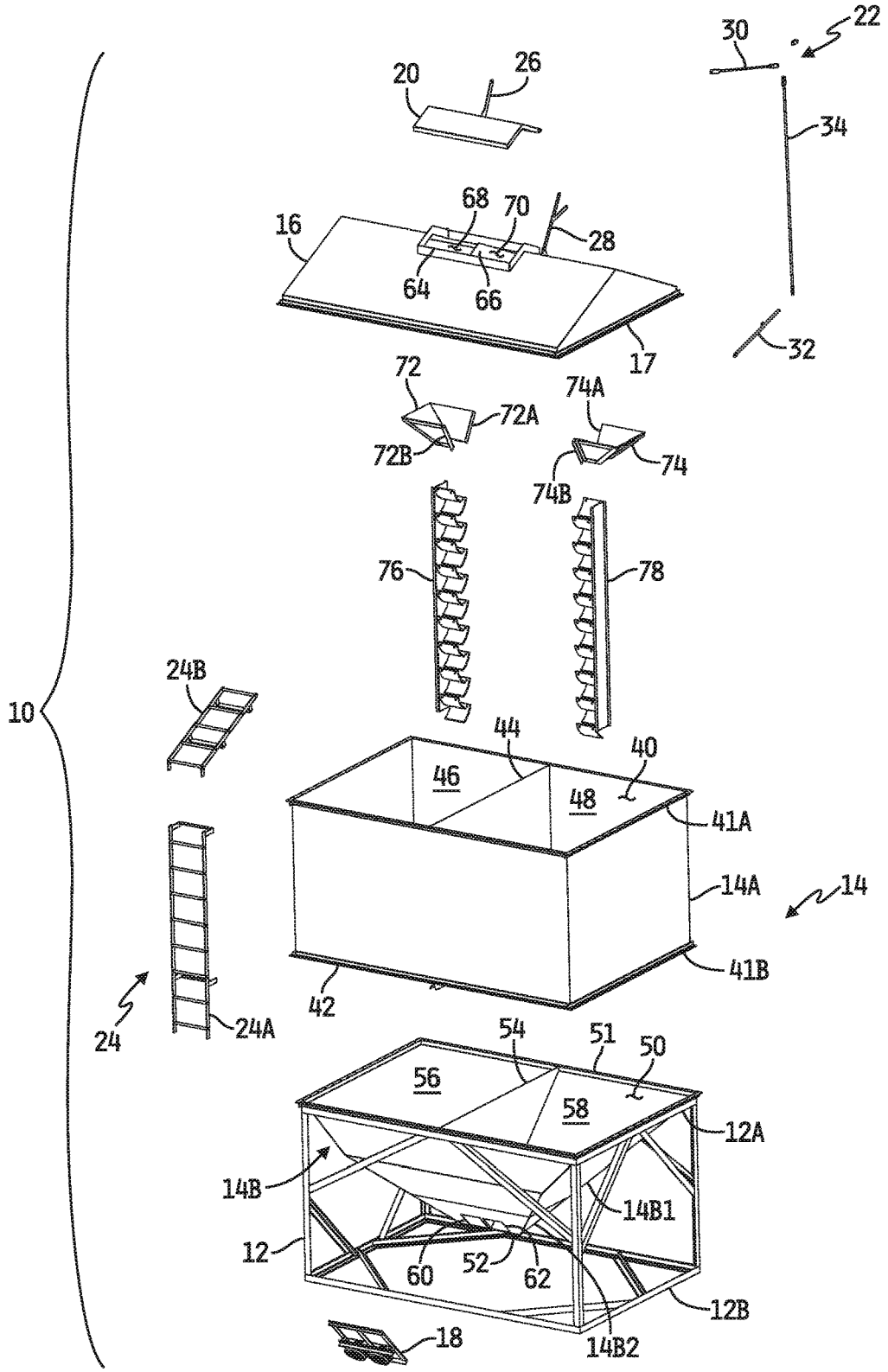
FIG. 3 is an assembly view of the seed storage and dispensing bin illustrated in FIGS. 1 and 2.

As most clearly shown in FIGS. 2 and 3, another flange or rim 41B illustratively extends outwardly and away from the upper walled enclosure 14A and surrounds the open bottom 42 thereof, and the flange 41B comes into contact with, is supported by and is secured to, the flange 51 of the lower walled enclosure 14B when the upper walled enclosure 14A is received on the lower walled enclosure 14B to form the walled container 14. Yet another flange or rim 41A illustratively extends outwardly and away from the upper walled enclosure 14A and surrounds the open top 40 thereof, and still another flange or rim 17 extends outwardly and away from the roof 16 and surrounds an open bottom thereof. The flange 17 illustratively comes into contact with, is supported by and is secured to, the flange 41A of the upper walled enclosure 14A when the roof 16 is received on the upper walled enclosure 14A. The seed storage and dispensing bin 10 is thus assembled in the field by suitably locating the frame 12, inserting the lower walled enclosure 14B into the frame 12 and securing the upper walled enclosure 14A to the lower walled enclosure 14B as just described. In some embodiments, one or more ladder assemblies, e.g., ladder assemblies 76 78, may be mounted within the walled container 14, and in any case the roof 16 is then secured to the upper walled enclosure 14A as just described.

Figure 4:
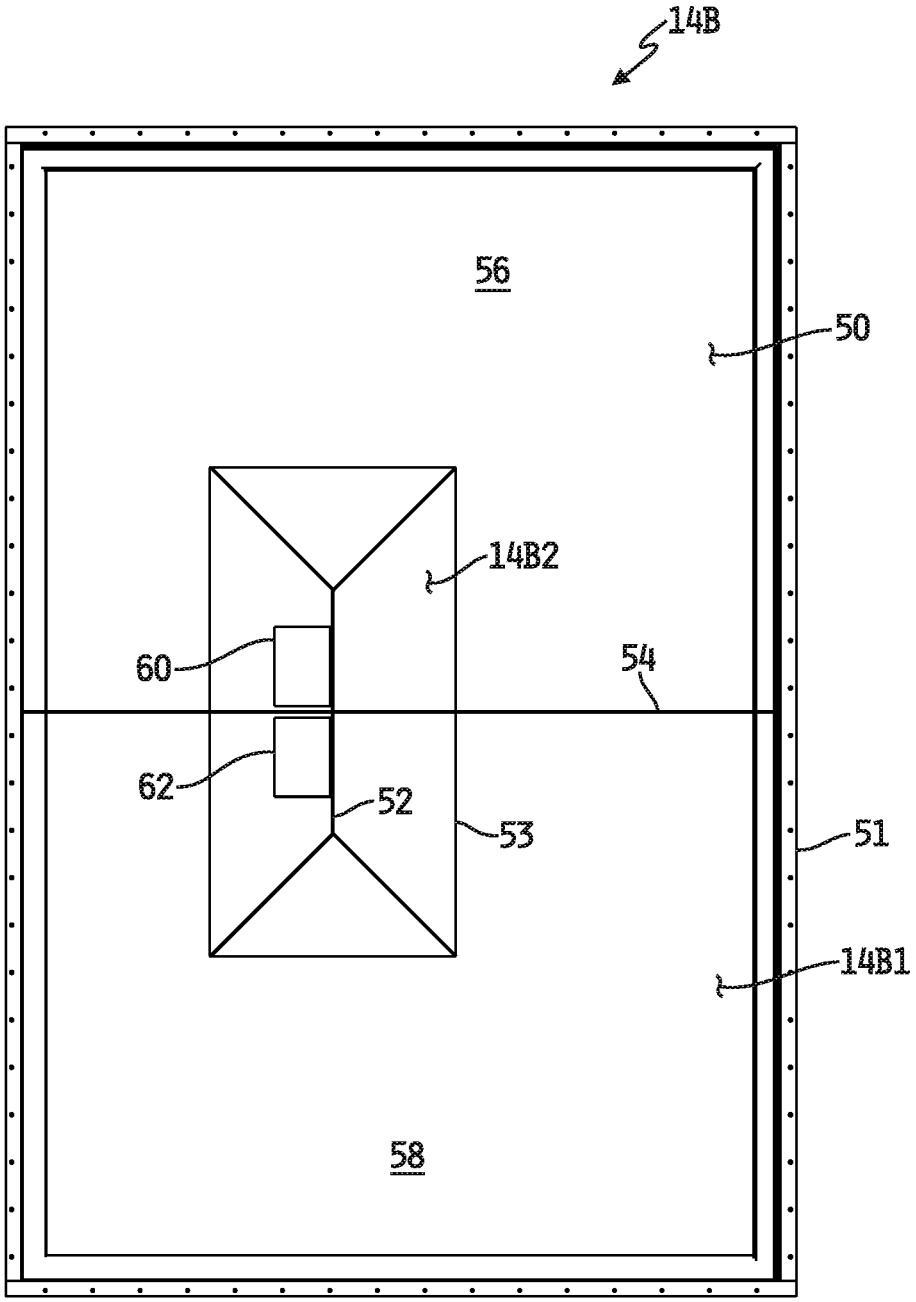
FIG. 4 is a top plan view of and embodiment of the lower walled enclosure of the seed storage and dispensing bin illustrated in FIGS. 1-3.

The walled enclosure 14 defines an interior space between the top 40 of the upper walled enclosure 14A and the bottom 52 of the lower walled enclosure 14B. In the illustrated embodiment, this interior space is illustratively portioned into two separate spaces by a divider 44 positioned within the upper walled enclosure 14A and another divider 54 positioned within the lower walled enclosure 14B. As most clearly shown in FIGS. 3 and 4, for example, the divider 54 is positioned transversely within, and substantially bisects, the interior space of the lower walled enclosure 14B. The interior space of the lower walled enclosure 14B is, in the illustrated embodiment, configured as a cascaded arrangement of a first rectangular and inwardly sloping portion 14B1 and a second rectangular and inwardly sloping portion 14B2 in communication with the first inwardly sloping portion 14B1, with the first inwardly sloping portion 14B1 positioned between the top 50 of the lower walled enclosure 14B and the second inwardly sloping portion 14B2 and with the second inwardly sloping portion 14B2 positioned between the bottom 52 of the lower walled enclosure 14B and the first inwardly sloping portion 14B1. The top end 50 of the first inwardly sloping portion 14B1 defines a first cross-sectional area, and an interface 53 between the inwardly sloping portions 14B1 and 14B2 defines a second cross-sectional area that is less than that of the first, such that the inner walls of the first inwardly sloping portion 14B1 slope inwardly and downwardly from the top 50 to the interface 53. The angle of the slope between the top end 50 and the interface 53 is illustratively selected to exceed the angle of repose of the seeds to thereby ensure downward flowability of the seeds from the first inwardly sloping portion 14B1 into the second inwardly sloping portion 14B2. The bottom 52 of the second inwardly sloping portion 14B2 is closed such that the inner walls of the second inwardly sloping portion 14*b*2 slope inwardly and downwardly from the interface 53 to the closed bottom end 52. The angle of the slope between the interface 53 and the bottom end 52 is likewise illustratively selected to exceed the angle of repose of the seeds within the second inwardly sloping portion 14B2 to ensure downward flowability of the seeds from the interface 53 toward the bottom end 52 thereof. In some embodiments, e.g., as illustrated in FIG. 4, the angle of the slope between the interface 53 and the bottom end 52 relative to a horizontal plane defined by the flange or rim 41A is greater than the angle of the slope between the top 50 and the interface 53. In any case, side-by-side openings 60, 62 are defined through the second inwardly sloping portion 14B2 adjacent to the bottom end 52 thereof, and the divider 54 illustratively bisects the wall of the second inwardly sloping portion 14B2 between the openings 60, 62 to define two separate spaces 56, 58 within the lower walled enclosure 14B with the opening 60 in communication with the space 56 and the opening 62 in communication with the space 58.

Figure 7:
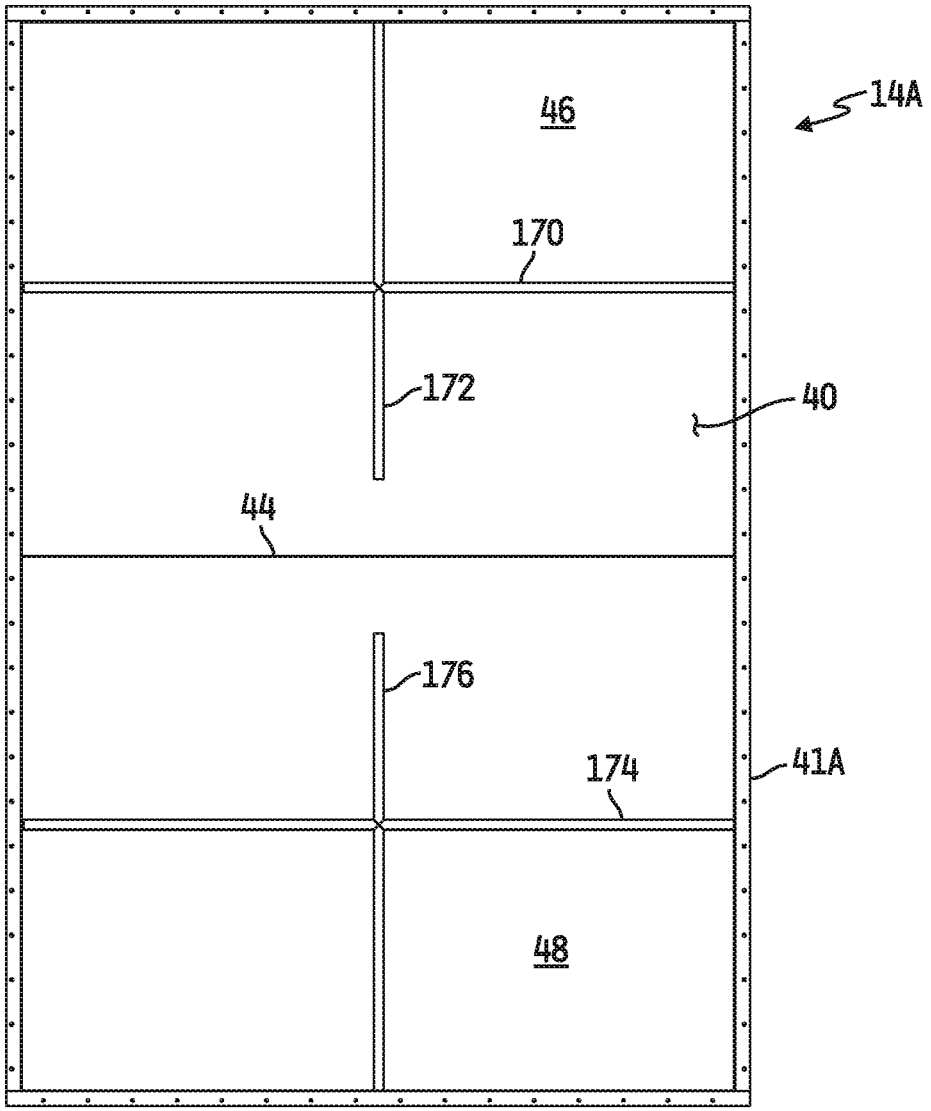
FIG. 7 is a top plan view of an embodiment of the upper walled enclosure of the seed storage and dispensing bin illustrated in FIGS. 1-3.

As most clearly shown in FIGS. 3 and 7, the upper walled enclosure 14A is illustratively a rectangular sleeve having opposing open ends 40 and 42, and the divider 44 is positioned transversely within, and substantially bisects, the interior space of the upper walled enclosure 14A into two separate spaces 46 and 48. When assembled, the divider 44 aligns with the divider 54 such that the two vertically aligned spaces 46 and 56 together define a first seed storage space within the walled container 14 and the two vertically aligned spaces 48 and 58 together define a second, separate seed storage space within the walled container 14.

Figure 5:
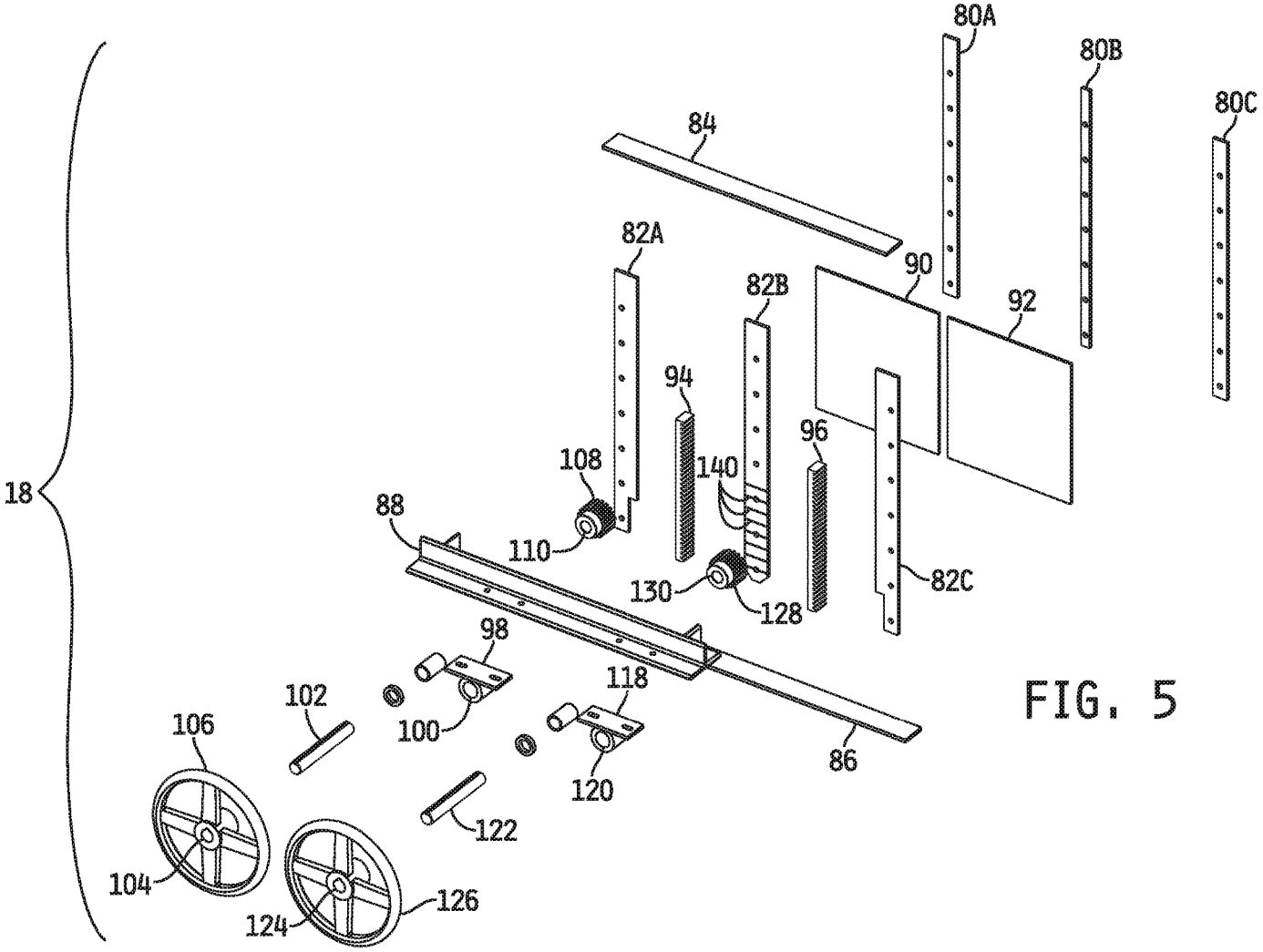
FIG. 5 is an assembly view of an embodiment of the lower door assembly of the seed storage and dispensing bin illustrated in FIGS. 1-3.

The roof 16 illustratively defines an opening 64 through a top end thereof, and a divider 66 is positioned transversely within, and substantially bisects, the interior space of the roof 16 into two separate spaces. The divider illustratively also bisects the opening 66 into two side-by-side openings 68 and 70 such that, when assembled, the divider 66 aligns with the divider 44 such that the opening 68 is in communication only with the vertically aligned spaces 46, 56 within the walled container 14 and the opening 70 is in communication only with the vertically aligned spaces 48, 58. Seeds of one type or variety may thus be released or otherwise dispensed into the opening 68 for storage within the vertically aligned spaces 46, 56, and seeds of the same or another type or variety may likewise be released or otherwise dispensed into the opening 70 for storage within the vertically aligned spaces 48, 58. Seeds stored within the vertically aligned spaces 46, 56 may be selectively dispensed from via the opening 60 in the lower walled enclosure 14B and/or seeds stored within the vertically aligned spaces 48, 58 may be selectively dispensed therefrom via the opening 62. Illustratively, a lower door assembly 18 is provided in some embodiments to close the openings 60, 62 and to control selective dispensing of stored seeds therefrom. An embodiment of such a door assembly 18 is illustrated in FIGS. 5-6B, the structure and operation of which will be described in detail below.

The roof 16 further includes a door 20 mounted thereto and a handle assembly 22 configured to move the door 20 between a closed position in which the door 20 completely covers the first and second openings 60, 62 and an open position in which the first and second openings 60, 62 are exposed. In some embodiments, an exterior ladder assembly 24 is mounted to the bin 10 to provide access to the openings 60, 62. In the illustrated embodiment, for example, one such ladder assembly 24 includes a first ladder 24A mounted to the upper walled enclosure 14A, and a second ladder 24B, coupled to the first ladder 24A, mounted to the roof 16. Together the ladders 24A, 24B form the ladder assembly 24 to provide access from the support surface 15 to the door 20 and openings 60, 62.

As most clearly shown in FIGS. 2 and 3, the door is hingedly connected to the roof 16 by a hinge 36. The handle assembly 22 illustratively includes a first elongated member affixed at one end to the door 20 and having an opposite end extending upwardly away from the top of the door 20 and affixed or hingedly connected to one end of a second elongated member 30. An elongated "Y" member 28 is hingedly connected at a lower end thereof to a rear of the roof 16, and the two branches of the " " member 28 extend upwardly and away from the rear of the roof 16. The terminal end of one branch of the "Y" member 28 is affixed or hingedly connected to the opposite end of the second elongated member 30, and the terminal end of the other branch is affixed or hingedly connected to one end of third elongated member 34. A handle member 32 is hingedly connected at one end to the rear of the frame 12, and its opposite terminal end extends outwardly away from the frame 12, e.g., in a horizontal position when the door 20 is closed as illustrated in FIG. 2. The opposite end of the third elongated member 34 is affixed or hingedly connected to the handle member 34 between the two ends thereof. In operation, a downward force 38 applied to the handle member 32 is translated through the elongated member 34 to cause the "Y" member 28 to pivot downwardly toward the support surface 15. This movement is translated through the elongated members 26, 30 to the door 20, thereby causing the door 20 to pivot about the hinge 36 to an open position. Closure of the door 20 is accomplished by returning the handle member 32 to its horizontal position as illustrated in FIG. 2.

It will be understood that this disclosure contemplates alternate embodiments in which the door 20 is provided in the form of two separate doors each configured to selectively close and expose a different one of the openings 68, 70. In such embodiments, the handle assembly 20 may be configured to selectively open/close both such doors simultaneously or may be alternately configured to selectively open/close each door separately. Modifications required to effectuate any such alternate embodiment will be a mere mechanical step for a skilled artisan.

Referring now to FIGS. 5-6B, an embodiment is shown of the lower door assembly 18. In the illustrated embodiment, the lower door assembly 18 includes three spaced-apart rear support plates or bars 80A, 80B, 80C, three corresponding, spaced-apart front support plates or bars 82A, 82B, 82C, a top plate 84, a bottom plate 86, a mid-plate 88 and a pair of doors 90, 92, e.g. in the form of sliding gates or plates. The door 90 is captured between two of the opposed pairs of spaced-apart rear and front support plates 80A, 82A and 80B, 82B respectively, and the door 92 is likewise captured between the two opposed pairs of spaced-apart rear and front support plates 80B, 82B and 80C, 82C respectively. The top, bottom and mid plates 84, 86 and 88 respectively are secured to the tops, bottom and middle sections of each of the support plates 80A, 80B, 80C and 82A, 82B, 82C. A first linear gear 94, e.g., a toothed bar, is affixed in a vertically-oriented manner to the front surface of the door 90, and a second linear gear 96, e.g., also a toothed bar, is affixed in a vertically-oriented manner to the front surface of the door 92.

A first bracket 98 is affixed to a bottom surface of the mid-plate 88 adjacent to the front surface of the door 90, and a second bracket 118 is affixed to the bottom surface of the mid-plate 88 adjacent to the front surface of the door 92. The bracket 98 defines a bore 100 therethrough sized to receive and allow rotational movement of a pin 102 therein, and an actuator wheel 106 defines another bore 104 therethrough sized to receive and engage the pin 102. A toothed gear wheel 108 is positioned between the bracket 98 and the front surface of the door 90, and the gear wheel 108 defines another bore 110 therethrough sized to receive and engage the pin 102 such that the teeth of the gear wheel 108 mesh with those of the linear gear 94 and the actuator wheel 106 and the gear wheel 108 rotate together relative to the bore 100 and relative to the linear gear 94. The bracket 118 likewise defines a bore 120 therethrough sized to receive and engage a pin 122 therein, and an actuator wheel 126 defines another bore 124 therethrough also sized to receive and engage the pin 122. Another toothed gear wheel 128 is positioned between the bracket 118 and the front surface of the door 92, and the gear wheel 128 defines another bore 130 therethrough sized to receive and engage the pin 102 such that the teeth of the gear wheel 128 mesh with those of the linear gear 96 and the actuator wheel 126 and the gear wheel 128 rotate together relative to the bore 120 and relative to the linear gear 96.

Figure 6A:
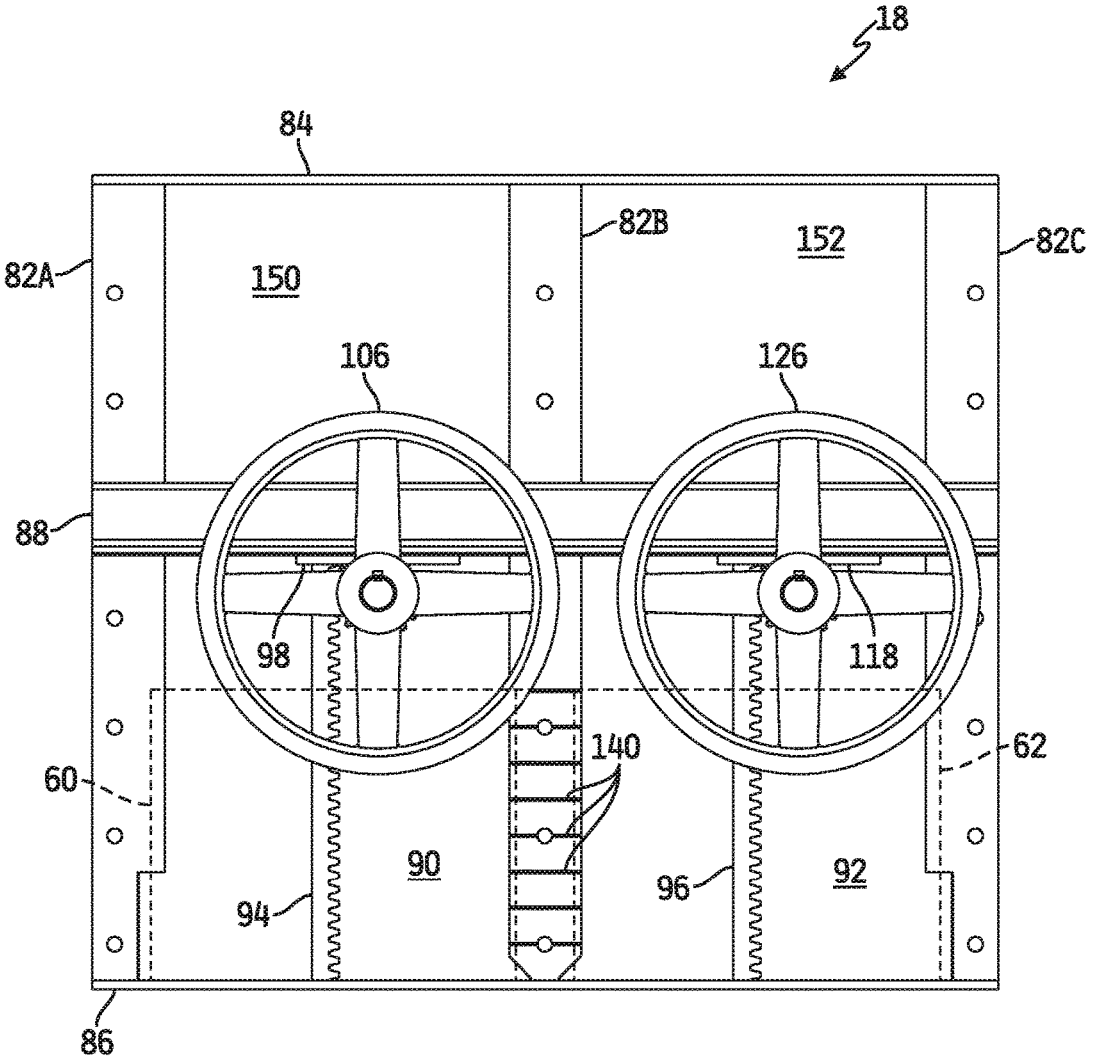
FIG. 6A is an assembled view of the lower door assembly of FIG. 5 shown with both doors in a closed position.
Figure 6B:
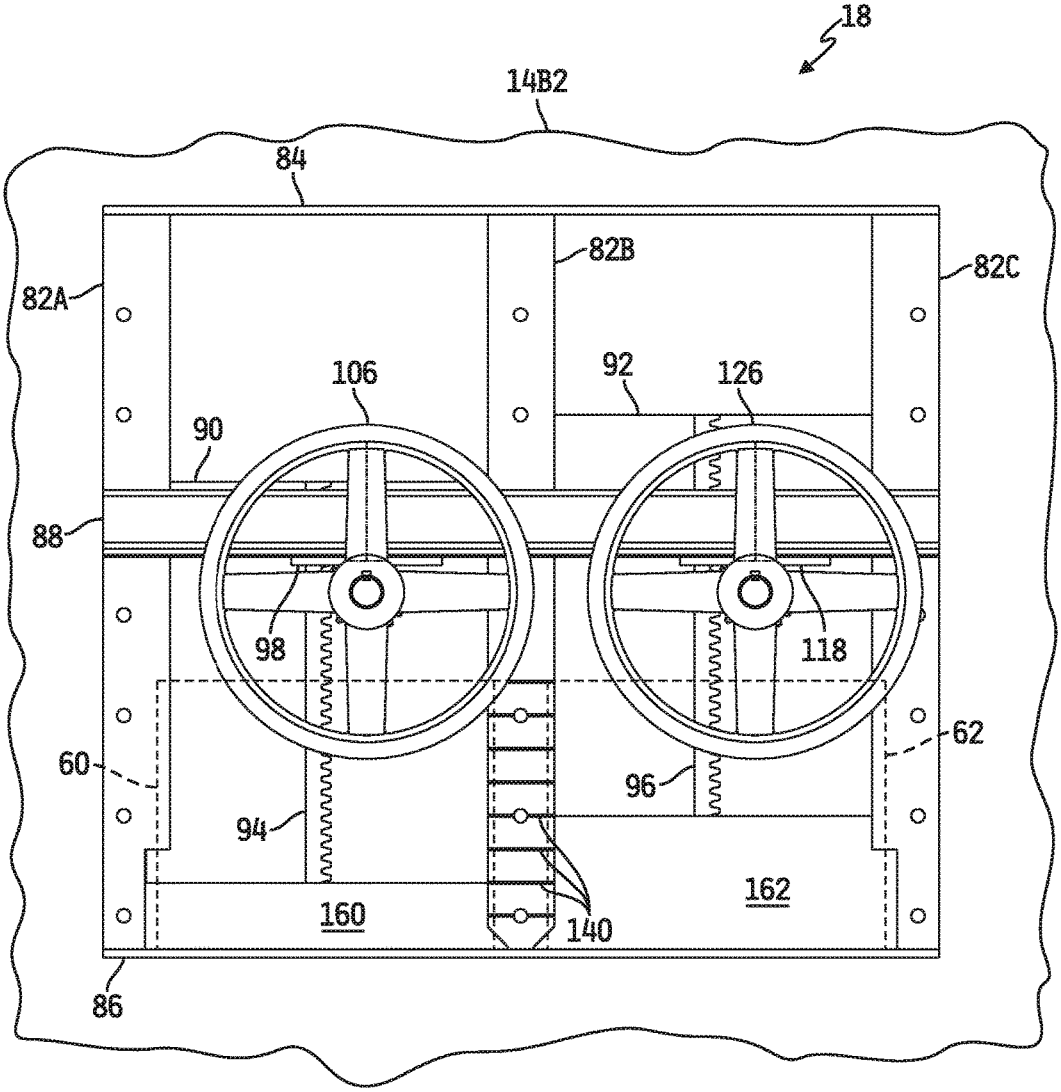
FIG. 6B is an assembled view of the lower door assembly of FIG. 5 mounted to the lower walled enclosure of the seed storage and dispensing bin illustrated in FIGS. 1-3 and shown with both doors partially open.

An assembled view solely of the lower door assembly 18 is illustrated in FIG. 6A, and in this view the areas 150 and 152 represent empty spaces above the doors 90 and 92 respectively with the doors 90, 92 both in their closed positions to completely cover the openings 60, 62 respectively. Although not actually part of the structure illustrated in FIG. 6A, the openings 60, 62 in the lower walled enclosure 14B are shown in dashed-line representation to illustrate the locations of the openings 60, 62 relative to the door assembly 18 when mounted to the lower walled enclosure 14B. In FIG. 6B, the door assembly 18 is, in contrast, shown mounted to the lower walled enclosure 14B such that the spaces above the doors 90, 92 represent the outer surface of the second inwardly sloping portion 14B2 of the lower walled enclosure 14B. Also in the view illustrated in FIG. 6B, the doors 90 and 92 are both partially opened, which is accomplished in the illustrated embodiment by rotating the actuator wheels 106, 126 clockwise. Either or both of the doors 90, 92 may be closed by rotating the actuator wheels 106 and/or 126 counterclockwise until the door 90 and/or 92 meets the bottom plate 86.

As illustrated in FIG. 6B, the doors 90, 92 are independently controllable to selectively expose some portion or all of the openings 60, 62 respectively. For example, the horizontal top of the dashed line 60 illustratively represents the position of the bottom horizontal edge of the door 90 with the maximum cross-sectional area of the opening 60 exposed, and the door 90 is incrementally movable between the closed position illustrated in FIG. 6A and a position which exposes the maximum cross-sectional area of the opening 60. Likewise, the horizontal top of the dashed line 62 illustratively represents the position of the bottom horizontal edge of the door 92 with the maximum cross-sectional area of the opening 62 exposed, and the door 92 is incrementally movable between the closed position illustrated in FIG. 6A and a position which exposes the maximum cross-sectional area of the opening 62. As used herein, the term "incrementally" should be understood to encompass both continuous and discrete increments of door position.

The position of the door 90 relative to the lower walled enclosure 14B is selectively controllable independently of the position of the door 92 relative to the lower walled enclosure 14B, and in the example illustrated in FIG. 6B the doors 90 and 92 have been controlled to positions which expose approximately twice the cross-sectional area of the opening 62 as compared to the exposed cross-sectional area of the opening 60. As illustrated in FIGS. 5-6C, the middle support plate or bar 82B includes a number of vertically spaced-apart, horizontally-extending marks 140 to provide a visual guide for setting a ratio of exposed cross-sectional areas of the openings 60, 62. In FIG. 6B, for example, since the bottom edge of the door 90 is aligned with the second mark 140 from the bottom and the bottom edge of the door 92 is aligned with the fourth mark 140 from the bottom, the exposed cross-sectional area 162 of the opening 62 is approximately twice that 160 of the exposed cross-sectional area of the opening 60. Other ratios are possible, and those skilled in the art will recognize that more or fewer markings 140 can be provided on the middle plate 82B and/or elsewhere (e.g., on either or both of the plates 82A, 82C) to provide greater or lesser ratio precision.

The exposed cross-sectional areas 160, 162 of the openings 60, 62 respectively define the flow rate of seeds exiting each of the separate, vertically aligned spaces 46, 56 and 48, 58 of the walled container 14. Independent control of the exposed cross-sectional areas of the openings 60, 62 via selective actuation of the doors 90, 92 respectively thus provides for the ability to control a mix ratio of seeds exiting the walled container 14. In the example illustrated in FIG. 6B, the positions of the doors 90, 92 resulting the exposed cross sectional areas 160, 162 respectively produces a seed mix ratio of 1:2 respectively. It will be understood that alternate embodiments of the walled container 14 and the door assembly 18 are contemplated which include more partitioned spaces and corresponding numbers of lower doors as just described to provide for the storage, dispensing, and potential mixing, of any number of different or like seed types or varieties. Those skilled in the art will recognize that it would be a mere mechanical step to extend the concepts illustrated and described herein to such variants. It will also be understood that the structure and operation of the door assembly 18 represents only one example embodiment thereof, and that this disclosure contemplates other embodiments of one or more mechanisms for selectively closing and exposing part or all of the openings 60, 62, examples of which may include, but are not limited to, structures/mechanisms configured to slide, pivot, rotate, linearly translate or otherwise move relative to either or both of the openings 60, 62 under mechanical, electromechanical, fluid and/or other conventionally applied force.

Figure 8:
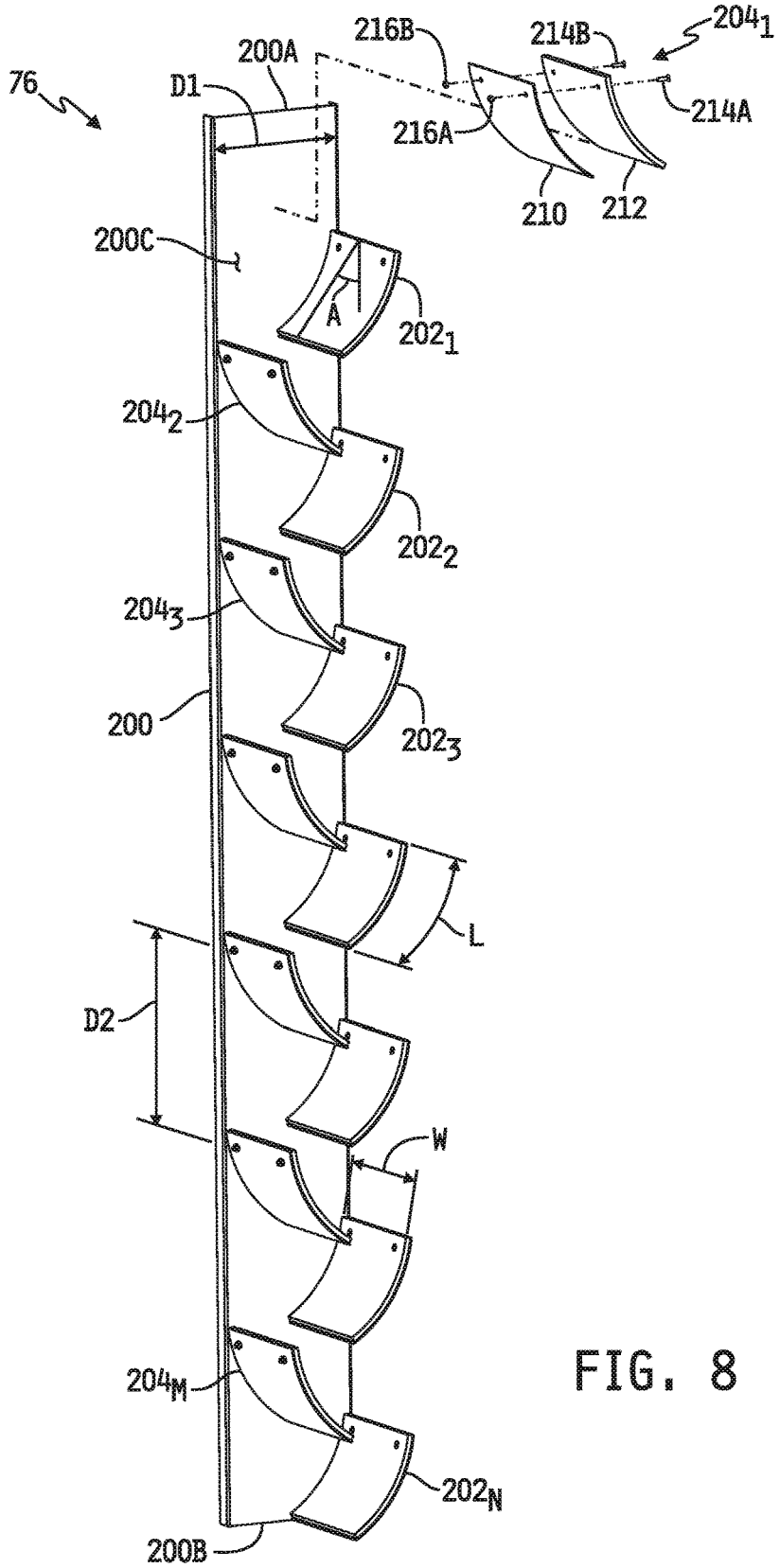
FIG. 8 is a perspective view of an embodiment of a ladder assembly of the seed storage and dispensing bin illustrated in FIGS. 1-3.

Referring now to FIGS. 3, 7 and 8 in particular, some embodiments of the seed storage and dispensing bin 10 may include one or more ladder assemblies configured to absorb at least some of the energy in seeds released or otherwise dispensed into the one or more openings in the roof 16 as such seeds fall into the walled container 14, thereby potentially reducing the likelihood and/or occurrence of damage to such seeds. In the embodiment illustrated in FIGS. 1-7, the seed storage and dispensing bin 10 is configured to define two separate, partitioned spaces 46, 56 and 48, 58, and in this example embodiment two ladder assemblies 76 and 78 are included; one in each of the spaces 46, 56 and 48, 58. It will be understood that in embodiments including more or fewer spaces 46, 56 and 48, 58, more or fewer such ladder assemblies 76, 78 may likewise be implemented.

Referring to FIG. 7 specifically, the space 46 illustratively includes a transverse support rod or plate 170 extending parallel to the divider 44 and affixed to the opposing walls of the upper walled enclosure 14A, and another support rod or bar 172 positioned normal to the support rod or plate 170 with one end affixed to the third wall of the upper walled enclosure 14A within the space 46 and an opposite free end extending toward the divider 44. Likewise, the space 48 illustratively includes a transverse support rod or plate 174 extending parallel to the divider 44 and affixed to the opposing walls of the upper walled enclosure 14A, and another support rod or bar 176 positioned normal to the support rod or plate 174 with one end affixed to the third wall of the upper walled enclosure 14A within the space 48 and an opposite free end extending toward the divider 44. Either or both of the support rods 170, 172 may be used to secure the ladder assembly 76 to the upper walled enclosure 14A within the space 46, and either or both support rods 174, 176 may be used to secure the ladder assembly 78 to the upper walled enclosure 14A within the space 48.

As illustrated in FIG. 3, a first guide member 72 illustratively has an open top positioned adjacent to the opening 68 defined through the top of the roof 16, and an open bottom positioned adjacent to the top end of the ladder assembly 76. Illustratively, the guide member 72 has three walls defining two exposed edges 72A, 72B, each of which is secured to the divider 66 to form a closed funnel structure with a cross-sectional area of the open top positioned adjacent to the first opening 68 and sized to be approximately equal to that of the opening 68, and a cross-sectional area of the open bottom less than that of the top and sized complementarily to the dimensions of the ladder assembly 76. A second guide member 74 illustratively has an open top positioned adjacent to the opening 70 defined through the top of the roof 16, and an open bottom positioned adjacent to the top end of the ladder assembly 78. Like the guide member 72, the guide member 74 illustratively has three walls defining two exposed edges 74A, 74B, each of which is secured to the divider 66 to form a closed funnel structure with a cross-sectional area of the open top positioned adjacent to the second opening 70 and sized to be approximately equal to that of the opening 70, and a cross-sectional area of the open bottom less than that of the top and sized complementarily to the dimensions of the ladder assembly 78. Each guide member 72, 74 is configured to guide seeds released into the opening 68, 70 respectively defined through the top of the roof 16 into the top end of the corresponding ladder assembly 76, 78. Each elongated ladder assembly 76, 78 is positioned in the interior space 46, 48 respectively of the walled container 14A with a top end thereof adjacent to the open bottom of the guide member 72, 74 respectively and with a bottom end thereof extending downwardly into the interior space 46, 48 respectively.

Referring now to FIG. 8, the ladder assembly 76 is illustrated in partial assembly view. In the illustrated embodiment, the ladder assembly 76 includes an elongated panel 200 of width D1 and having a top end 200A and a bottom end 200B opposite the top end 200A. The panel 200 is illustratively positioned within the bin 10 with the top end 200A adjacent to the bottom end of the guide member 72 and with the bottom end 200B extending downwardly into the space 46 defined by the upper wall enclosure 14A. In some embodiments, the bottom end 200B of the panel 200 may extend downwardly into the space 56 defined by the lower wall enclosure 14B.

One or more paddles or leaves $\mathbf{202}_1$-$\mathbf{202}_N$ of width W and length L are mounted along one side of the panel 200 and vertically spaced apart relative to each other, e.g., by an amount D2, along the length of the panel 200 such that one side of each paddle $\mathbf{202}_1$-$\mathbf{202}_N$ along its length is proximate to a planar face 200C of the panel 200. Likewise, one or more paddles or leaves $\mathbf{204}_1$-$\mathbf{204}_M$ of width W and length L are mounted along the opposite side of the panel 200 and vertically spaced apart relative to each other along the length of the panel 200 such that one side of each paddle $\mathbf{204}_1$-$\mathbf{204}_M$ along its length is proximate to a planar face 200C of the panel 200. Illustratively, M and N may be any positive integer, and M may or may not be equal to N. In any case, the paddles $\mathbf{202}_1$-$\mathbf{202}_N$ are illustratively interlaced with the paddles $\mathbf{204}_1$-$\mathbf{204}_M$ along at least a portion of a length of the panel 200 with an upper edge of each positioned proximate to one side of the panel 200 and a lower edge of each extending inwardly toward the center of the panel 200. In some embodiments, such as that illustrated in FIG. 8, the paddles $\mathbf{202}_1$-$\mathbf{202}_N$ and $\mathbf{204}_1$-$\mathbf{204}_M$ are curved inwardly, e.g., concave, with a radius "A" of curvature relative to vertical, although in other embodiments the paddles $\mathbf{202}_1$-$\mathbf{202}_N$ and $\mathbf{204}_1$-$\mathbf{204}_M$ may be flat or have some other shape but still mounted on the panel 200 at the angle "A" relative to vertical. In one embodiment, the angle or radius "A" is approximately 30 degrees, although in other embodiments the radius or angle "A" may range from between 5-10 degrees and 75-85 degrees. In any case, the paddles $\mathbf{202}_1$-$\mathbf{202}_N$ and $\mathbf{204}_1$-$\mathbf{204}_M$ are illustratively arranged on the panel 200 such that seeds released at the top of the ladder assembly 76 tumble sequentially between alternating ones of the plurality of interlaced paddles $\mathbf{202}_1$-$\mathbf{202}_N$ and $\mathbf{204}_1$-$\mathbf{204}_M$ as they move downwardly along the ladder assembly 76 and into the walled container 14. At least some of the energy in seeds released or otherwise dispensed into the opening 68 in the roof 16 is absorbed by the paddles $\mathbf{202}_1$-$\mathbf{202}_N$ and $\mathbf{204}_1$-$\mathbf{204}_M$ as such seeds fall into the walled container 14, thereby potentially reducing the likelihood and/or occurrence of damage to such seeds.

In some embodiments, as illustrated in FIG. 8, an energy-absorbing member 212 may be mounted or affixed, e.g., via conventional fixation members 214A, 214B and 216A, 216B, to one or more of the paddles $\mathbf{202}_1$-$\mathbf{202}_N$ and $\mathbf{204}_1$-$\mathbf{204}_M$. Each such energy-absorbing member(s) illustratively is or includes one or more materials selected or otherwise configured to absorb energy resulting from impact of seeds with one or more such paddles $\mathbf{202}_1$-$\mathbf{202}_N$ and $\mathbf{204}_1$-$\mathbf{204}_M$ as seeds tumble between the alternating ones of the interlaced paddles $\mathbf{202}_1$-$\mathbf{202}_N$ and $\mathbf{204}_1$-$\mathbf{204}_M$. The one or more materials may be or include one or more natural and/or synthetic materials. In one example embodiment, the energy absorbing member(s) 212 are Urethane sheets, although in other embodiments other conventional cushioning materials or material combinations may be used.

In one example implementation, which should not be considered to be limiting in any way, the frame 12 is approximately 144 inches long, 96 inches wide and 84.25 inches in height. The bottom of the lower walled enclosure 14B is approximately 23.375 inches above the ground 15 when mounted to the frame 12. The walled enclosure 14A is approximately 72 inches in height, and the roof 16 is illustratively 30.375 inches in height such that the fully assembled seed storage and dispensing bin 10 stands approximately 185.625 inches in height. Those skilled in the art will recognize other dimensions that may be used in the implementation of any one or more of the components of the seed storage and dispensing bin 10 just described, and it will be understood that any such other dimension(s) of any such component(s) is/are contemplated by this disclosure.

Referring now to FIGS. 9-13D, another embodiment of a seed storage and dispensing bin 10' is shown. In the illustrated embodiment, the seed storage and dispensing bin 10', is like the seed storage and dispensing bin 10 described above, illustratively portable in that it may be transported to a desired location and/or from one location to another, and/or assembled, partially or wholly, in the field. In any case, the seed storage and dispensing bin 10' is, also like the seed storage and dispensing bin 10 described above, configured to receive, store therein and selectively dispense one or more types or varieties of seeds.

Figure 9:
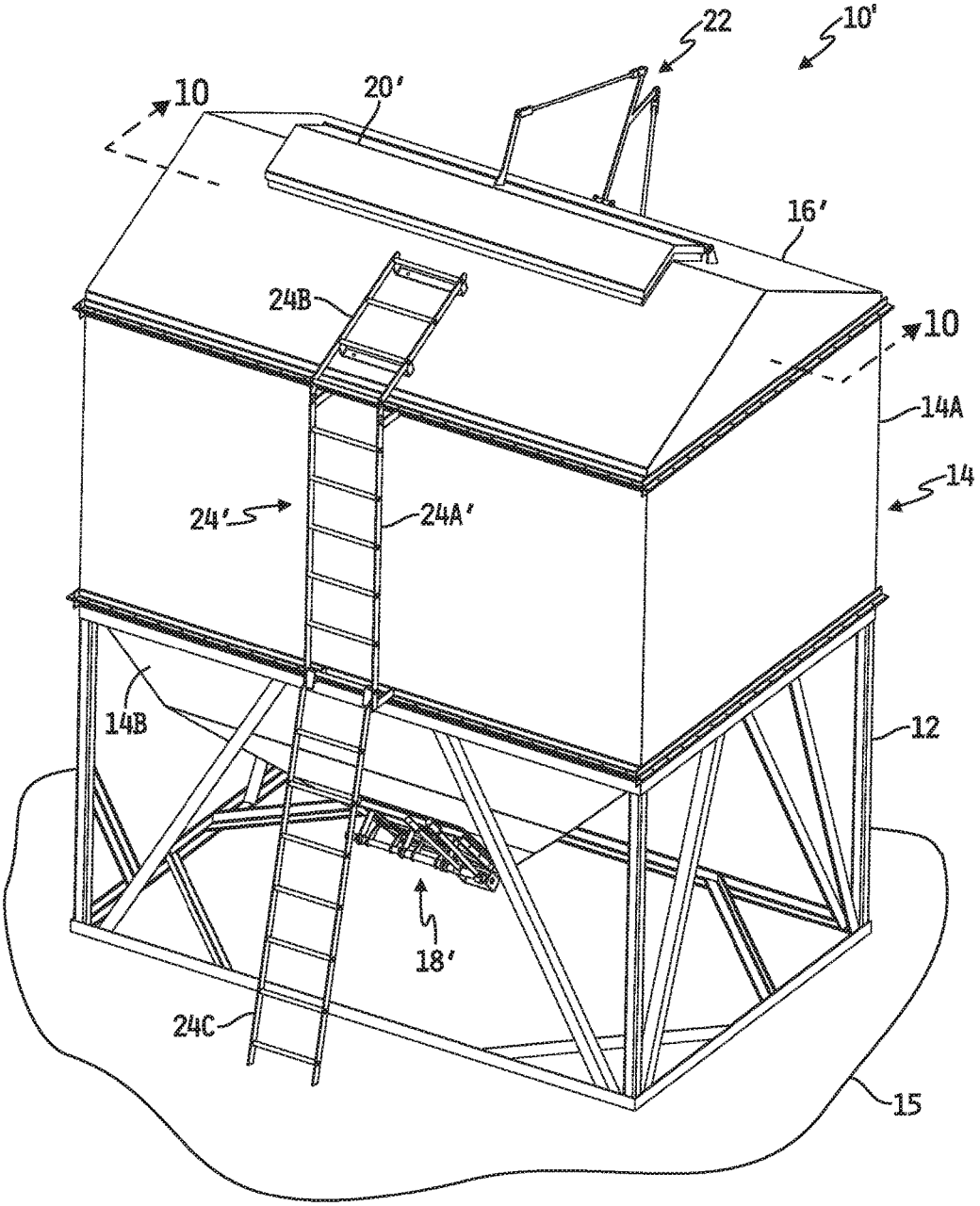
FIG. 9 is a front perspective view of another embodiment of a seed storage and dispensing bin.

The seed storage and dispensing bin 10' is illustratively identical in many respects to the seed storage and dispensing bin 10 illustrated in FIGS. 1-10 and described above, and like numbers are therefore used to identify like components. In one aspect, the seed storage and dispensing bin 10' differs from the seed storage and dispensing bin 10 in that the ladder 24A of the ladder assembly 24 is illustratively replaced with a shorter ladder 24A' in the ladder assembly 24' as illustrated in FIG. 9, and the ladder assembly 24' includes a third ladder 24C connectable to and detachable from the ladder 24A'. As illustrated in FIG. 9, the ladder 24A' is illustratively configured or sized such that the lower end of the ladder 24A' terminates approximately at the junction of the upper walled enclosure 14A and the lower walled enclosure 14B. In one example implementation of the bin 10' illustrated in FIG. 9, the distance from the ground 15 to the lower end of the ladder 24A' is approximately seven feet, and such position of the lower terminal end of the ladder 24A' is illustratively selected so to prevent or impede access to the ladder 24A' from the ground by unauthorized persons, i.e., persons without access to the ladder 24C or similar ladder. In other implementations, the ladder 24A' may be sized so as to place the terminal end thereof at any desired height above the ground 15 or other relative to any other suitable component of the bin 10'.

In another aspect, the seed storage and dispensing bin 10' differs from the seed storage bin 10 illustrated in FIGS. 1-8 in that the roof or top 16 is illustratively replaced with a roof or top 16' defining an opening 64' therethrough that is more elongated, i.e., defines a greater open area between the two ends 16A, 16B, than that of the opening 64 defined through the roof or top 16. Illustratively, such an elongated opening 64' facilitates filling of the bin 10' with seeds and, in some embodiments, facilitates accommodation of a pair of seed slides $\mathbf{300}_1$, $\mathbf{300}_2$ in embodiments which include such seed slides $\mathbf{300}_1$, $\mathbf{300}_2$. In embodiments which include the alternate roof 16', the opening 64' defined therethrough illustratively defines adjacent openings 68', 70' separated by a wall 66 which is aligned with the wall 44 of the lower walled enclosure 14 when the roof 16' is received thereon as described above.

In the illustrated embodiment, the two ladder assemblies 76 and 78 of the seed storage and dispensing bin 10 are illustratively replaced in the seed storage and dispensing bin 10' with a corresponding pair of seed slides $\mathbf{300}_1$, $\mathbf{300}_2$. In alternate embodiments, only one of the ladder assemblies 76, 78 may be replaced with a seed slide $\mathbf{300}_1$, $\mathbf{300}_2$, and in still other alternate embodiment the two ladder assemblies 76, 78 may be implemented instead of the seed slides $\mathbf{300}_1$, $\mathbf{300}_2$ even though the roof 16 may be replaced with the roof 16'.

Figure 10:
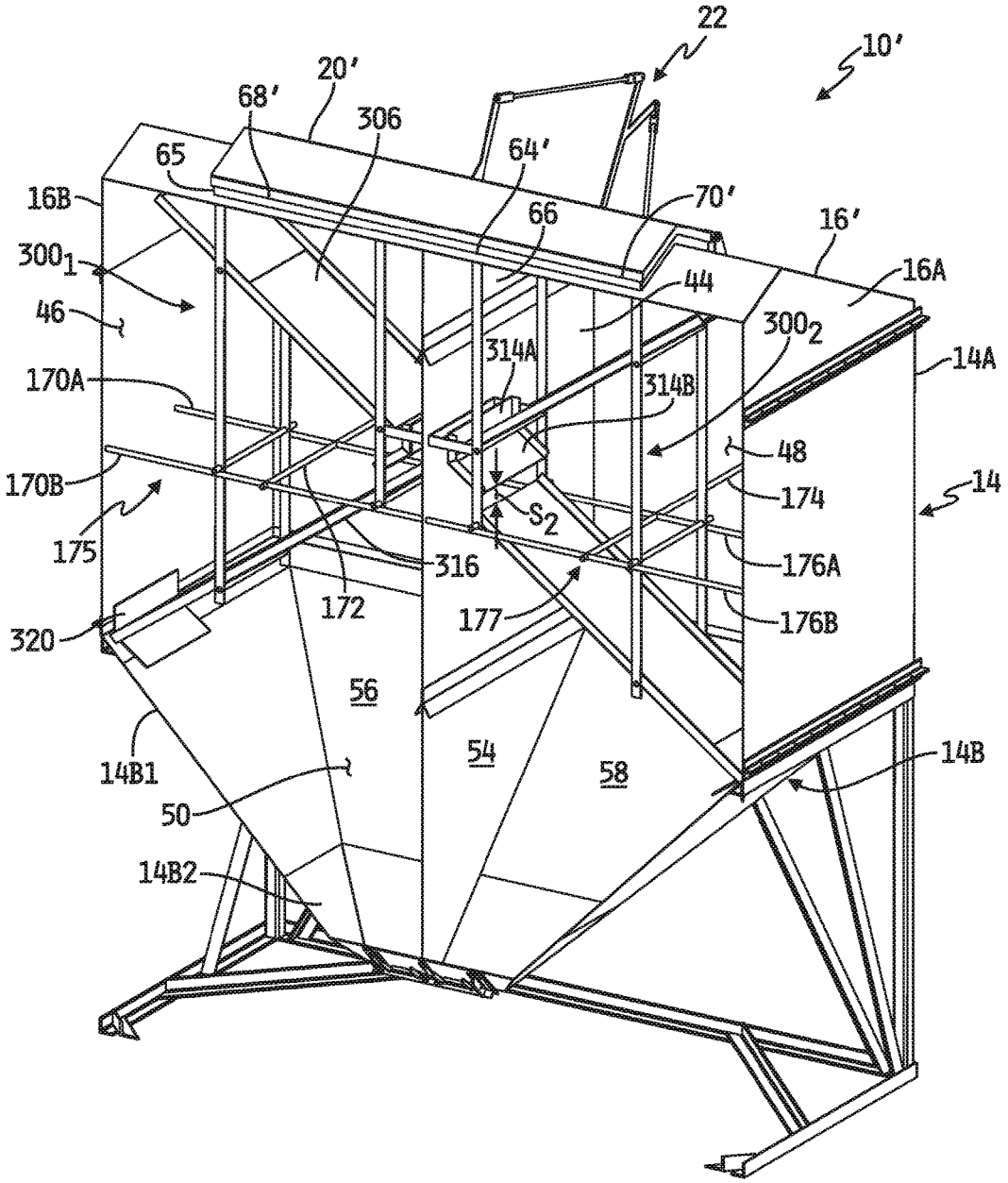
FIG. 10 is a cross-sectional view of the seed storage and dispensing bin of FIG. 9 as viewed along section lines 10-10.

Referring now to specifically to FIG. 10, an embodiment of one of the seed slides $\mathbf{300}_1$ is shown positioned within and supported within the vertically aligned spaces 46, 56 of the walled enclosure 14. In some embodiments, the seed slide $\mathbf{300}_2$ is an identical mirror image of the seed slide $\mathbf{300}_1$ and is positioned and supported within the vertically aligned spaces 48, 58 of the walled enclosure 14 in the same manner as will be described with respect to the seed slide $\mathbf{300}_1$. In other embodiments, the seed slide $\mathbf{300}_2$ may differ from the seed slide $\mathbf{300}_1$ in one or more structures on or via which seeds are transported by the slide $\mathbf{300}_2$ into the walled enclosure 14 and/or in the manner in which the seed slide $\mathbf{300}_2$ is mounted to and/or supported by the walled enclosure 14.

Figure 11:
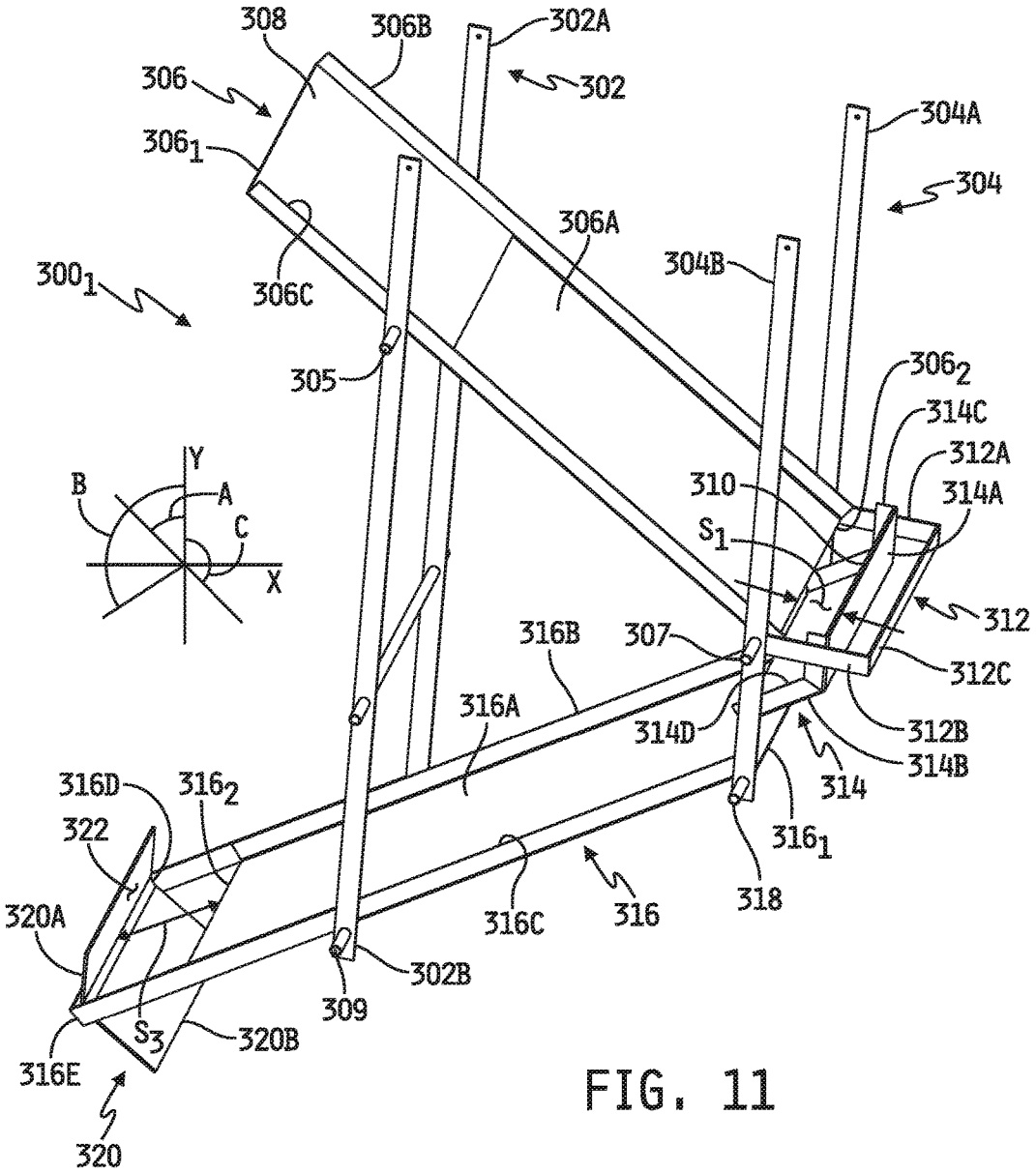
FIG. 11 is a front perspective view of an embodiment of a seed slide assembly of the seed storage and dispensing bin illustrated in FIGS. 9 and 10.

Referring now to FIGS. 10 and 11, the illustrated seed slide $\mathbf{300}_1$ includes two sets of mounting frames 302 and 304 each configured to be mounted to the upper walled enclosure 14A and also to either side of each of an upper seed slide 306 and a lower seed slide 316, wherein the upper seed slide 306 illustratively slopes downwardly in a first direction from a top end $\mathbf{306}_1$ toward a bottom end $\mathbf{306}_2$ thereof and the lower seed slide 316 illustratively slopes downwardly in a second direction, opposite the first direction, from a top end $\mathbf{316}_1$ positioned under the bottom end of the upper seed slide 306 toward a bottom end $\mathbf{316}_2$ thereof. The mounting frame 302 illustratively includes a pair of frame members 302A, 302B, and the mounting frame 304 illustratively includes another pair of frame members 304A, 304B. The upper seed slide 306 illustratively includes an elongated seed transport bed 306A flanked by upstanding side walls 306B, 306C extending along each side thereof between the top and bottom ends $\mathbf{306}_1$, $\mathbf{306}_2$ of the seed transport bed 306A. The lower seed slide 316 illustratively includes an elongated seed transport bed 316A flanked by upstanding side walls 316B, 316C extending along each side thereof from the top end $\mathbf{316}_1$ to and beyond the bottom end $\mathbf{316}_2$ of the seed transport bed 316A. In one embodiment, the seed transport beds 306A, 316A are each illustratively flat, i.e., planar, although in other embodiments either or both of the seed transport beds 306A, 316A may be non-planar. In still other embodiments, either seed transport bed 306A, 316A may be shaped in the axial or longitudinal direction such that at least a portion thereof between its opposing sides is generally lower than at or adjacent to the opposing sides, e.g., concave, triangular, multiple-concave, etc., and in such embodiments the side walls 306B, 306C/316B, 316C may or may not be omitted. In one embodiment the length of the seed beds 306, 316, i.e., from the ends $\mathbf{306}_1$, $\mathbf{316}_1$ to the opposite ends $\mathbf{306}_2$, $\mathbf{316}_2$, are approximately 64 inches each, although it will be understood that in alternate embodiments the lengths of the seed beds 306, 316 may be different from each other and/or may have other values.

The frame members 304A, 304B are illustratively mounted to opposing sides of the upper seed slide 306 at or near the bottom end $\mathbf{306}_2$ thereof, and to opposing sides of the bottom seed slide 316 at or near the top end $\mathbf{316}_1$ thereof. The frame members 302A, 302B are illustratively mounted to opposing sides of the upper slide 306 near the top end $\mathbf{306}_1$, and to opposing sides of the bottom seed slide 316 near the bottom end $\mathbf{316}_2$ thereof. In the illustrated embodiment, the frame members 302A, 302B and 304A, 304B are each mounted to the side walls 306B, 306C of the upper seed slide 306 and to the side walls 316B, 316C of the lower seed slide 316, e.g., via one or more conventional fixation members 305, 307, 308, 309 as illustrated by example in FIG. 11. In some embodiments, one or more of such fixation members 305, 307, 308, 309 may be used to support the seed slide $300_1$ within the space 46 and/or the space 56 defined in the walled enclosure 14.

The upper and lower seed slides 306, 316 each illustratively define an angle with respect to vertical planes defined by the frame members 302A, 302B, 304A and 304B, or with respect to horizontal planes defined by the upper and lower rims 41A, 41B of the walled enclosure 14; see, e.g., FIGS. 2 and 3. The vertical plane defined by the vertical surfaces of the frame members 304A, 304B facing the bottom end $306_2$ of the seed transport bed 306A is illustratively represented by the "Y" axis and the horizontal plane defined by the upper lower rims 41A, 41B of the walled enclosure 14 is illustratively parallel with the "X" axis in the coordinate system graphic illustrated in FIG. 11. In one example embodiment, with the X-axis extending through the bottom end $306_2$ of the seed transport bed 306A, the elongated seed transport bed 306A illustratively defines an angle, A, relative to the positive Y-axis, i.e., in the direction from the bottom $306_2$ of the seed transport bed 306A toward the top $306_1$ pf the seed transport bed, of approximately −55 degrees (or approximately −145 degrees relative to the positive X-axis) and, with the X-axis extending through the top end $316_1$ of the seed transport bed 316A, the elongated seed transport bed 316A illustratively defines an angle, B, relative to the positive Y-axis, i.e., in the direction from the top $316_1$ of the seed transport bed 316A toward the bottom $316_2$ of the seed transport bed 316A, of approximately −115 degrees (or approximately −155 degrees relative to the positive X-axis), as also depicted in the coordinate system graphic illustrated in FIG. 11. It will be understood that in alternate embodiments, the angles A and B may take on other values, e.g., between approximately −5 degrees and −85 degrees relative to the positive Y-axis with respect to the angle A and between approximately −95 degrees and −175 degrees relative to the positive Y-axis with respect to the angle B, and that any such alternate angles of A and/or B are intended to fall within the scope of this disclosure.

Between the bottom end $306_2$ of the lower seed slide 306 and the top end $316_1$ of the lower seed slide 316 a bracket 312 is mounted to and between each of the frame members 304A, 304B. The bracket 312 illustratively includes a first leg 312A having one end mounted to and extending substantially perpendicularly away from the frame member 304A, a second leg 312B having one end mounted to and extending substantially perpendicularly away from the frame member 304B, and a cross-member 312C extending substantially perpendicularly between the opposite ends of the first and second legs 312A, 312B. Illustratively, the legs 312A, 312B and the cross-member 312C are of unitary construction, although in alternate embodiments the legs 312A, 312B and/or the cross-member 312C may be separate components affixed or secured together in a conventional manner. The legs 312A, 312B are illustratively mounted to the frame members 304A, 304B via the fixation member(s) 307, although it will be understood that in alternate embodiments the bracket 312 may be affixed to the frame members 304A, 304B at other locations and/or with other fixation structures, or may alternatively or additionally be affixed to other structure(s) of the ladder $300_1$ or of the walled enclosure 14. The opposite surfaces of the cross-member 312C facing toward and away from the frame members 304A, 304B are illustratively planar and substantially parallel with a vertical plane defined by the frame members 304A, 304B.

A deflector plate 314 is illustratively mounted to the bracket 312 for the purpose of directing and re-orienting the flow of seeds reaching the lower end $306_2$ of the upper seed slide 306 to the lower seed slide 316. In the illustrated embodiment, the deflector plate 314 includes upper and lower plates 314A, 314B, with each plate 314A, 314B illustratively flanked by upstanding sidewalls 314C, 314D. The upper and lower plates 314A, 314B are illustratively planar plates each defining a plane along its major planar surface, although in other embodiments either or both of the plates 314A, 314B may be non-planar. In one embodiment, the deflector plate 314 is of unitary construction, although in alternate embodiments the upper and lower plates 314A, 314B may be separate structures joined together in a conventional manner. The planar surface of the upper plate 314A facing the upper seed slide 306 is illustratively spaced apart from the lower end $306_2$ of the seed transport bed 306A by a distance $S_1$ (see FIG. 11), and the generally upwardly-facing planar surface of the lower plate 314B is illustratively spaced apart from the generally upwardly facing surface of the seed transport bed 316A of the lower seed slide 316 by a distance $S_2$ (see FIG. 10). In one embodiment, $S_1$ is approximately 4.8125 inches and $S_2$ is approximately 4.8125 inches, although it will be understood that in alternate embodiments $S_1$ and/or $S_2$ may have other values.

The deflector plate 314 is illustratively configured and mounted to the bracket 312 such that each of the upper and lower plates 314A, 314B define an angle relative to the bracket 312, frame members 304A, 304B and seed slides 306, 316. In one example embodiment with the Y-axis depicted in FIG. 11 extending through the plane of the upper plate 314A, the planar surface of the upper plate 314A illustratively defines an angle of approximately zero degrees relative to the positive Y-axis and, with the X-axis depicted in FIG. 11 extending through the junction of the upper and lower plates 314A, 314B, the planar surface of the lower plate 314B illustratively defines the angle B, e.g., −115 degrees, although it will be understood that in alternate embodiments the angle of the planar surface of the upper plate 314A and/or the angle of the planar surface of the lower plate 314B may be set at other angles relative to the positive Y-axis or other reference plane. In the illustrated embodiment, the plane defined by the opposing surfaces of the cross-member 312C of the mounting plate is illustratively parallel with the Y-axis and, thus, parallel with the planar surface of the upper plate 314A.

In the illustrated embodiment, the upstanding sidewalls 316B, 316C of the lower seed slide 316 extend beyond the bottom end $316_2$ of the lower seed slide 316 to terminal ends 316D, 316E respectively. Another deflector plate 320 is illustratively mounted to and between the upstanding sidewalls 316B, 316C of the lower seed slide 316 at or adjacent to the terminal ends 316D, 316E thereof. The deflector plate 320 is illustratively mounted to the lower seed slide 316 for the purpose of directing and re-orienting the flow of seeds reaching the lower end $316_2$ of the lower seed slide 316 approximately centrally into the space 56 defined within the walled enclosure 14B. In the illustrated embodiment, the deflector plate 320 includes upper and lower plates 320A, 320B respectively. The upper and lower plates 320A, 320B are illustratively planar plates each defining a plane along its major planar surface, although in other embodiments either or both of the plates 320A, 320B may be non-planar. In one embodiment, the deflector plate 320 is of unitary construction, although in alternate embodiments the upper and lower plates 320A, 320B may be separate structures joined together in a conventional manner. The planar surface of the upper plate 320A facing the lower seed slide 316 is illustratively spaced apart from the lower end $316_2$ of the seed transport bed 316A by a distance $S_3$ (see FIG. 11. In one embodiment, $S_3$ is approximately 8.8125 inches, although it will be understood that in alternate embodiments $S_3$ may have other values.

The deflector plate 320 is illustratively configured and mounted to the upstanding sidewalls 316B, 316C such that each of the upper and lower plates 320A, 320B define an angle relative to the frame members 302A, 302B, the frame members 304A, 304B and/or seed slide(s) 306, 316. In one example embodiment with the Y-axis depicted in FIG. 11 extending through the plane of the upper plate 320A, the planar surface of the upper plate 320A illustratively defines an angle of approximately zero degrees relative to the Y-axis and, with the X-axis depicted in FIG. 11 extending through the junction of the upper and lower plates 320A, 320B, the upwardly-facing planar surface of the lower plate 320B illustratively defines an angle C relative to the positive Y-axis, e.g., 125 degrees, although it will be understood that in alternate embodiments the angle of the planar surface of the upper plate 320A and/or the angle of the planar surface of the lower plate 314B may be set at other angles relative to the positive Y-axis or other reference plane. In some alternate embodiments, for example, the angle C may take on other values, e.g., between approximately 5 degrees and 185 degrees relative to the positive Y-axis, and it will be understood that any such alternate angles C are intended to fall within the scope of this disclosure.

In some embodiments, the tops of the frame members 302A, 302B, 304A, 304B are configured to be attached to the roof 16 at or adjacent to the opening 64'. In one embodiment, as illustrated by example in FIG. 10, the tops of the frame members 302A, 302B, 304A, 304B are mounted, e.g., via one or more conventional fixation members, to a lip or flange 65 surrounding the opening 68' to the vertically aligned spaces 46, 56 of the walled enclosure 14. In other embodiments, only the tops of the frame members 302A, 302B, the tops of the frame members 304A, 304B or one of each set of frame members 302A, 302B and 304A, 304B may be mounted to the a lip or flange 65 surrounding the opening 68'.

In any case, at least one of the fixation members 305, 307, 309 and 318 or set thereof may be supported within the walled enclosure 14A via one or more sets of support frames or rods. In the embodiment illustrated in FIG. 10, for example, the seed slide $\mathbf{300}_1$ is supported by the support frame 175 including spaced apart support frames or rods 170A, 170B extending between the outer wall of the walled enclosure and the divider 44 and another support frame or rod 172 extending transversely between and coupled to the support frames or rods 170A, 170B. In particular, the seed slide $\mathbf{300}_1$ is supported by the support frame 175 via contact with and between the fixation members 318 on either side of the frame members 304A, 304B and the support frames or rods 170A, 170B respectively. Those skilled in the art will recognize that one or more additional support frames may be positioned within the space 46 defined within the walled enclosure 14A and configured to support the seed slide $\mathbf{300}_1$ via contact with and between such one or more additional support frames and one or more of the remaining pairs of fixation members 305 and 309 extending from either side of the frame members 302A, 302B and/or the fixation members 307 extending from either side of the frame members 304A, 304B, and it will be understood that any such additional support frames and corresponding support locations of the seed slide $\mathbf{300}_1$ are contemplated by this disclosure.

In the illustrated embodiment, the seed slide $\mathbf{300}_1$ is further supported within the space 46 defined by the walled enclosure 14A via contact between the planar face of the cross-member 312C which faces away from the upper and lower seed slides 306, 316 and the divider 44 dividing the spaces 46 and 48 of the walled enclosure 14A, and also via contact between the face of the upper plate 320A which faces away from the lower seed slide 316 and an outer wall of the walled enclosure 14A opposite the divider 44.

In some embodiments, as illustrated by example in FIG. 11, at least a portion of the seed transport bed 306A of the upper seed slide 306 adjacent to and extending downwardly away from the top end $\mathbf{306}_1$ thereof is covered by an energy-absorbing member or layer 308. Alternatively or additionally, either or both of the faces of the top and bottom plates 312A, 312B of the deflector plate 312 which face the upper and lower seed slides 306, 316 respectively may be covered by another energy-absorbing member or layer 310. Alternatively or additionally still, either or both faces of the top and bottom plates 320A, 320B of the deflector plate 320 which face the lower seed slide 316 may be covered by another energy-absorbing member or layer 322. Any of the energy-absorbing members or layers 308, 310, 322 may be mounted or affixed, e.g., via conventional fixation members, to its respective structure. Each such energy-absorbing member or layer 308, 310, 322, if included on the seed slide $\mathbf{300}_1$, illustratively is or includes one or more materials selected or otherwise configured to absorb energy resulting from impact of seeds with the corresponding underlying structure as seeds are loaded into the walled enclosure 14A, with impact of seeds with the deflector plate 312 as the seeds travelling along the upper seed slide 306 are directed by the deflector plate 312 to the lower seed slide 316 and with impact of seeds with the deflector plate 320 as the seeds travelling along the lower seed slide 316 are directed by the deflector plate 320 into the walled enclosure 14B. The one or more materials may be or include one or more natural and/or synthetic materials. In one example embodiment, the energy absorbing material is provided in the form of one or more Urethane sheets, although in other embodiments other conventional cushioning materials or material combinations may be used.

The seed slide $\mathbf{300}_2$ is illustratively a mirror image of the seed slide $\mathbf{300}_1$ and is configured identically as described with respect to the seed slide $\mathbf{300}_1$. The seed slide $\mathbf{300}_2$ is illustratively received and supported within the space 48 defined within the walled enclosure 14A as described with respect to the seed slide $\mathbf{300}_1$, e.g., via attachment of one or more of the frame members 302A, 302B, 304A, 304B to the lip or flange 65 partially surrounding the opening 70' defined through the roof 16', via contact with a support frame 177 including spaced apart support frames or rods 176A, 176B extending between the outer wall of the walled enclosure 14A and the divider 44 and another support frame or rod 174 extending transversely between and coupled to the support frames or rods 176A, 176B, and also via contact between the planar face of the cross-member 312C which faces away from the upper and lower seed slides 306, 316 and the divider 44 dividing the spaces 46 and 48 of the walled enclosure 14A, and via contact between the face of the upper plate 320A which faces away from the lower seed slide 316 and an outer wall of the walled enclosure 14A opposite the divider 44, all as illustrated in FIG. 10.

As seeds are loaded into the opening 68' (and/or into the opening 70'), the seeds illustratively fall onto the upper seed slide 306 of the seed slide $\mathbf{300}_1$ (and/or of the seed slide $\mathbf{300}_2$), and in particular onto the energy-absorbing member or layer 308 in embodiments which include the energy-absorbing layer or member 308, and thereafter slide under the force of gravity down the seed transport bed 306A. As the seeds reach the bottom end $306_2$ of the seed slide 306, they are directed, to travel in an opposite direction, to the top end $316_1$ of the lower seed slide 316 by the deflection plate 312, and thereafter slide under the force of gravity down the seed transport bed 316A. As the seeds reach the bottom end $316_2$ of the lower seed slide 316, they are directed, to again travel in an opposite direction, into the space 56 defined by the walled container 14B and the divider 54 (or into the space 58 defined by the walled container 14B and the divider 54). As seeds fill the space 56 (or 58) defined within the walled container 14B and begin to fill the space 46 (or 48) defined within the walled container 14A, seeds traveling down the lower seed slide 316 eventually begin contacting the rising collection of seeds and begin spilling over the sides of the lower seed slide 316 and into the space 46 (or 48). As seeds continue to fill the space 46 (or 48), seeds traveling down the upper seed slide 306 likewise eventually begin contacting the rising collection of seeds and begin spilling over the sides of the upper seed slide 316 and into the space 46 (or 48) until the space 46 (or 48) becomes filled or loading of the seeds into the bin 10' ceases.

Although only one example embodiment of a seed slide assembly is illustrated in the attached figures, this disclosure contemplates other embodiments which may include more, fewer and/or differently oriented seed slides. As one example, the illustrated multi-bed slide $300_1$ and/or $300_2$ may be alternatively implemented in the form of a single linear, e.g., angled, or non-linear, e.g., spiral, seed slide. As another example, the illustrated multi-bed slide $300_1$ and/or $300_2$ may alternatively include additional linear and/or non-linear seed slides. Accordingly, it should be understood that the example seed slide and/or ladder assemblies illustrated in the attached figures are provided only by way of example, and should not be considered limiting in any way. Rather, those skilled in the art will recognize other example seed slide and/or ladder configurations that may be implemented in a seed storage bin of the type described herein, and it will be understood that any such other seed slide and/or ladder configurations are contemplated by this disclosure.

Figure 12:
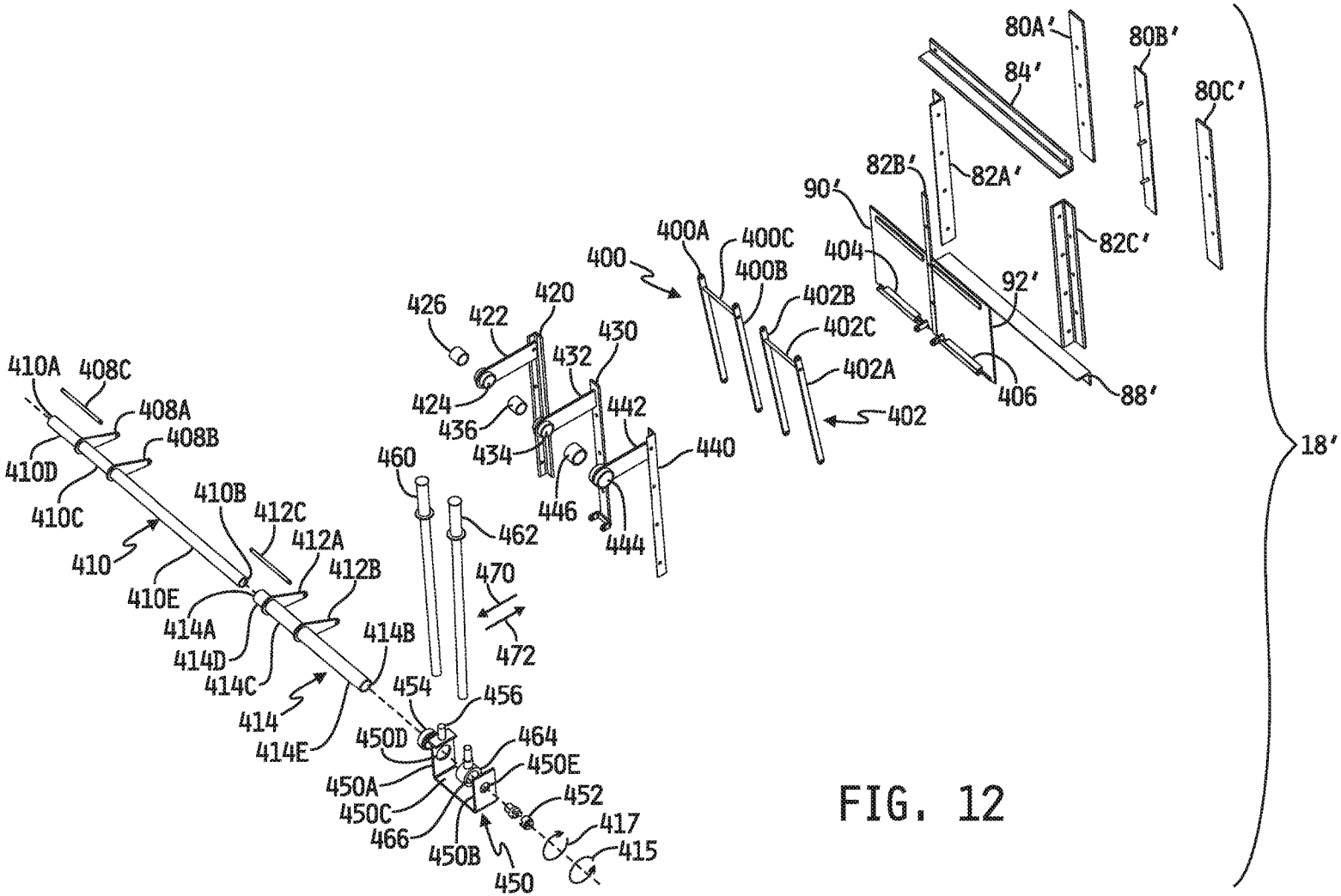
FIG. 12 is a is an assembly view of an embodiment of the lower door assembly of the seed storage and dispensing bin illustrated in FIGS. 9 and 10.

In yet another aspect, the seed storage and dispensing bin 10' differs from the seed storage bin 10 illustrated in FIGS. 1-8 in the inclusion of an alternate embodiment of the lower door assembly 18' which replaces the lower door assembly 18 of the seed storage and dispensing bin 10. The lower door assembly 18', like the lower door assembly 18 described above, is provided in some embodiments to close the openings 60, 62 and to control selective dispensing of stored seeds therefrom. An embodiment of such a lower door assembly 18' is illustrated in FIGS. 12-13D, the structure and operation of which will be described in detail below. The lower door assembly 18' is similar in some respects to the lower door assembly 18 described above, and similar numbers are therefore used to identify similar components in FIGS. 12-13D.

Referring specifically to FIG. 12, the lower door assembly 18' includes three spaced-apart rear support plates or bars 80A', 80B', 80C', three corresponding, spaced-apart pairs of front support plates or bars 82A' and 420, 82B' and 430, and 82C' and 440, a top plate 84', a bottom plate 88' and a pair of doors 90', 92', e.g. in the form of sliding gates or plates. The door 90' is captured on an outer side thereof between the rear support plate 80A' and the pair of front support plates 82A', 420 and on its opposite inner side between the pair of rear support plates 80B', 82B" and the front support plate 430. The door 92' likewise on an outer side thereof between the rear support plate 80C' and the pair of front support plates 82C', 440 and on its opposite inner side between the pair of rear support plates 80B', 82B" and the front support plate 430. The top and bottom plates 84,' and 88' respectively are secured to the top and bottom sections of each of the rear support plates 80A', 80B' and 80C'.

A door lifting bracket 400 includes a pair of elongated bracket members 400A, 400B and a middle bracket connector 400C transversely attached to and between the bracket members 400A, 400B between opposite ends thereof. An elongated lower bracket connector 404 is affixed at least partially along its length to a lower portion of the door 90'. One end of the bracket member 400A is affixed to one end of the lower bracket connector 404, and one end of the bracket member 400B is affixed to the opposite end of the lower bracket connector 404. Spaced-apart upper brackets 408A, 408B are affixed to and at least partially about a rotatable shaft 410 such that a portion 410C of the shaft 410 extends between the brackets 408A, 408B. One end of an elongated upper bracket shaft 408C extends through and is affixed to a free end of the upper bracket 408A and is rotatably coupled to an opposite end of the bracket member 400A, and an opposite end of the elongated upper bracket shaft 408C extends through and is affixed to a free end of the upper bracket 408B and is rotatably coupled to an opposite end of the bracket member 400B. As the shaft 410 rotates in the direction 415, the bracket members 400A, 400B thus pivot about the upper bracket shaft 408C to raise the door 90' to at least partially expose the opening 60 defined through the inwardly sloping portion 14B2 of the lower walled enclosure 14B, and as the shaft 410 rotates in the opposite direction 417, the bracket members 400A, 400B pivot about the upper bracket shaft 408C to lower the door 90' over the opening 60.

Another door lifting bracket 402 includes a pair of elongated bracket members 402A, 402B and a middle bracket connector 402C transversely attached to and between the bracket members 402A, 402B between opposite ends thereof. An elongated lower bracket connector 406 is affixed at least partially along its length to a lower portion of the door 92'. One end of the bracket member 402A is affixed to one end of the lower bracket connector 406, and one end of the bracket member 402B is affixed to the opposite end of the lower bracket connector 406. Spaced-apart upper brackets 412A, 412B are affixed to and at least partially about another rotatable shaft 414 such that a portion 414C of the shaft 414 extends between the brackets 412A, 412B. One end of another elongated upper bracket shaft 412C extends through and is affixed to a free end of the upper bracket 412A and is rotatably coupled to an opposite end of the bracket member 402A, and an opposite end of the elongated upper bracket shaft 412C extends through and is affixed to a free end of the upper bracket 412B and is rotatably coupled to an opposite end of the bracket member 402B. As the shaft 414 rotates in the direction 415, the bracket members 402A, 402B thus pivot about the upper bracket shaft 412C to raise the door 92' to at least partially expose the opening 62 defined through the inwardly sloping portion 14B2 of the lower walled enclosure 14B, and as the shaft 414 rotates in the opposite direction 417, the bracket members 402A, 402B pivot about the upper bracket shaft 412C to lower the door 92' over the opening 62.

A shaft bracket 422 is affixed at one end to the front support plate 420, and an opposite end of the shaft bracket 422 defines a bore 424 therethrough sized to receive a bearing 426 therein. Another shaft bracket 432 is affixed at one end to the front support bracket 430, and an opposite end of the shaft bracket 432 defines another bore 434 therethrough sized to receive a bearing 436 therein. The bearings 426 and 436 each illustratively define bores therethrough sized to receive the shaft 410 therein and therethrough. The bearing 426 is received on and over one end 410A of the shaft 410 and is positioned on a portion 410D of the shaft between the shaft end 410A and the upper bracket 408A, and the bearing 436 is received on and over the opposite end 410B of the shaft 410 and is positioned on a portion 410E of the shaft between the shaft end 410B and the upper bracket 408B. The combination of the shaft 410 and bearing 426 is received within the bore 424 and the combination of the shaft 410 and the bearing 436 is received within the bore 434 such that the shaft 410 extends through both shaft brackets 422, 432 with the both upper brackets 408A, 408B and the portion 410C of the shaft 410 positioned between the shaft brackets 422, 432, and such that the shaft 410 is rotatable relative to both of the shaft brackets 422, 432.

Another shaft bracket 442 is affixed at one end to the front support plate 440, and an opposite end of the shaft bracket 442 defines another bore 444 therethrough sized to receive another bearing 446 therein. The bearing 446 illustratively defines a bore therethrough sized to receive the shaft 414 therein and therethrough. The bearing 446 is slidably received on and over one end 414B of the shaft 414 and is positioned on a portion 414E of the shaft between the shaft end 414B and the upper bracket 412B. The shaft 414 illustratively defines a bore axially therethrough sized to receive the shaft 410 therein. The end 410B of the shaft 410 is axially received within the end 414A of the shaft 414, and the combination of the shaft 414 and bearing 446 is received within the bore 444 such that the shaft 414 extends through the shaft bracket 442 and the shaft 410 extends into the shaft 414 with a portion 414D of the shaft 414 between the end 414A and the upper bracket 412A positioned over the portion 410E of the bracket 414, with both upper brackets 412A, 412B and the portion 414C of the shaft 414 positioned between the shaft brackets 432, 442 and with the portion 414E of the bracket 414 between the upper bracket 412B and the end 414B extending transversely away from the upper shaft bracket 412B, and such that the shaft 414 is rotatable relative to the shaft 410 and relative to the shaft bracket 442.

A door actuator bracket 450 is operatively coupled to each of the rotatable shafts 410, 414 to provide for independent actuation, i.e., raising and lowering, of the doors 90', 92'. The door actuator bracket 450 illustratively defines a pair of spaced-apart, substantially parallel plates 450A, 450B joined by a transverse plate 450C. Illustratively, the plates 450A, 450B and 450C are of uniform construction, although in alternate embodiments two or more of the plates 450A, 450B, 450C may be separate components joined together in a conventional manner. The plate 450A defines a bore 450D therethrough sized to receive the shaft 414 therein, and the plate 450B defines a bore 450E therethrough sized to receive a fixation member 452, e.g., a threaded bolt, therein. A bearing 454 is sized to be received within the bore 450D defined through the plate 450A, and the bearing 454 defines a bore therethrough sized to receive the shaft 414 therein. A lever coupling member 456 is affixed to the free end of the plate 450A. One end of an elongated lever 460 is attached to the lever coupling member 456 such that the door actuator bracket 450 moves with the lever 460, and an opposite end of the elongated lever 460 extends upwardly away from the free end of the plate 450A. Another collar 464 is affixed to one end of another elongated lever 462, and an opposite end of the lever 462 extends upwardly away from the collar 464. The collar 464 defines a bore 466 therethrough sized to receive the shaft 414 therein.

The bearing 454 is received over the end 414B of the shaft 414 and is positioned on the portion 414 E of the shaft 414 between the end 414B and the upper bracket 412B. The combination of the shaft 414 and the bearing 454 is received within the bore 450D such that the bracket 450 is rotatable about and relative to the shaft 414, and the collar 464 is then received over the end of the shaft 414B and secured to the portion 414E of the shaft with the collar 464 positioned between the plates 450A, 450B. The end 410B of the shaft 410 is illustratively configured to receive and engage the fixation member 452 extending into the bore 450E such that the shaft 410 is affixed to, and rotates with, the bracket 450. With the collar 464 affixed to the shaft 414 and to the lever 462, movement of the lever 462 in the direction 470 rotates the shaft 414 in the direction 417, thereby raising the door 92' to expose at least a portion 480 of the opening 62 as illustrated in FIG. 13B, and movement of the lever 462 in the direction 472 rotates the shaft 414 in the direction 415, thereby lowering the door 92' as illustrated in FIG. 13C. Similarly, with the plate 450B of the door actuator bracket 450 affixed to the end 410B of the shaft 410 extending through the end 414B of the shaft 414 and with the plate 450A of the bracket 450 affixed to the lever 460, movement of the lever 460 in the direction 470 causes the bracket 450 to rotate the shaft 410 in the direction 417 as the bracket 450 rotates about the shaft 414 with the aid of the bearing 454, thereby raising the door 90' to expose at least a portion 490 of the opening 60 as illustrated in FIG. 13C, and movement of the lever 460 in the direction 472 rotates the shaft 410 in the direction 415, thereby lowering the door 90' as illustrated in FIG. 13B. Movement of both levers 460, 462 in the direction 470 causes both doors 90', 92' to raise as illustrated in FIG. 13D, and movement of both levers 460, 462 in the direction 472 causes both doors 90', 92' to be lowered and closed as illustrated in FIG. 13A.

Figure 13A:
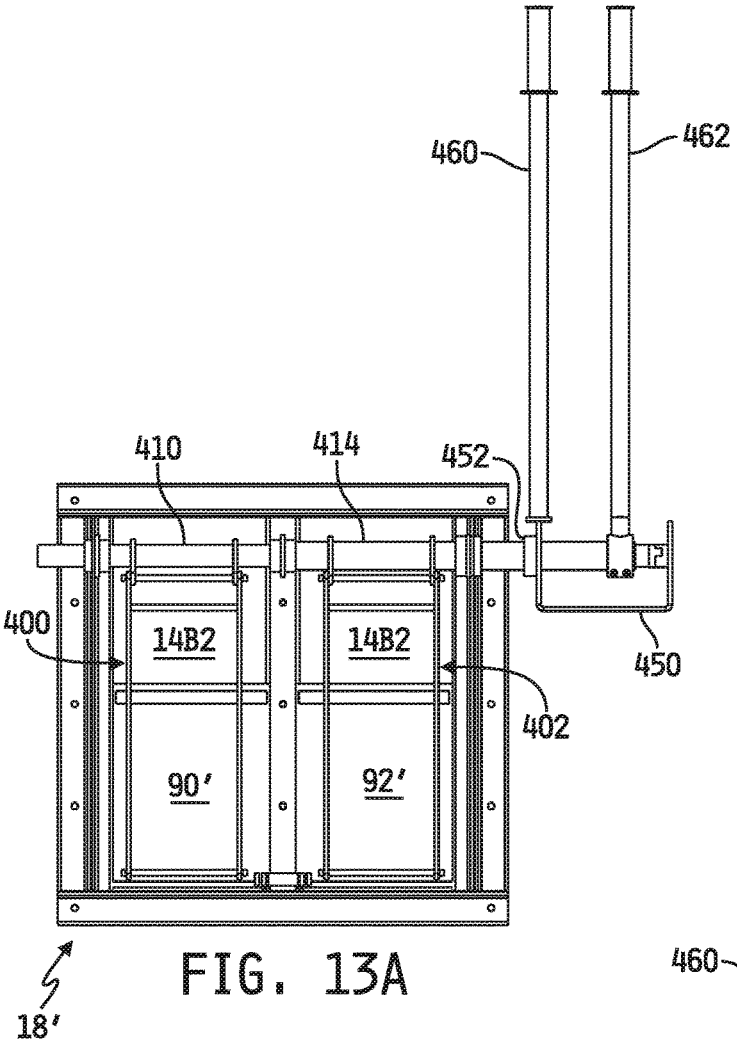
FIG. 13A is an assembled view of the lower door assembly of FIG. 12 shown with both doors in a closed position.
Figure 13B:
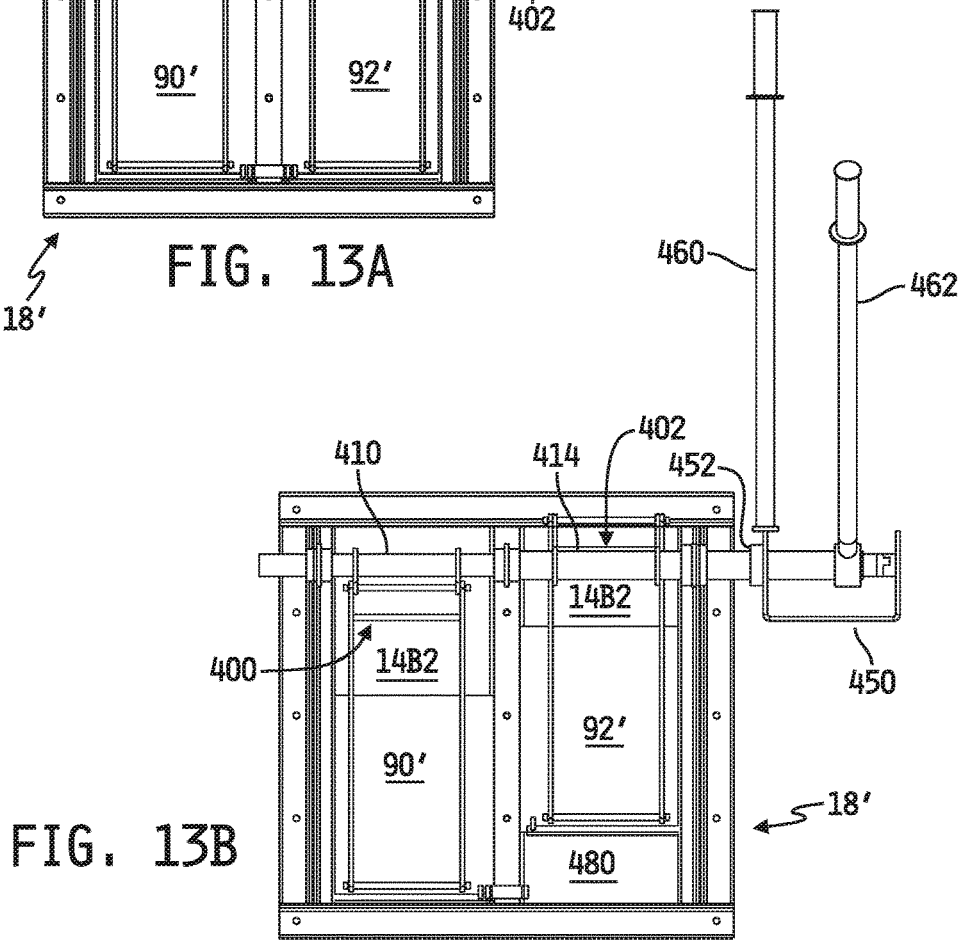
FIG. 13B is an assembled view of the lower door assembly of FIGS. 12 and 13A shown with one of the two doors in a partially open position.
Figure 13C:
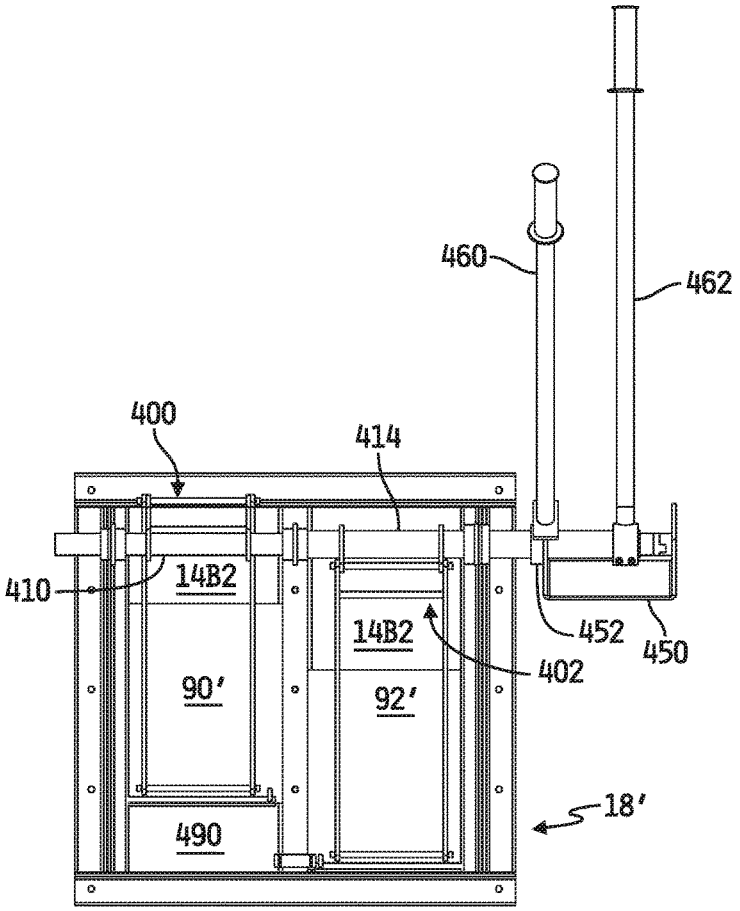
FIG. 13C is an assembled view of the lower door assembly of FIGS. 12-13B shown with the other of the two doors in a partially open position.
Figure 13D:
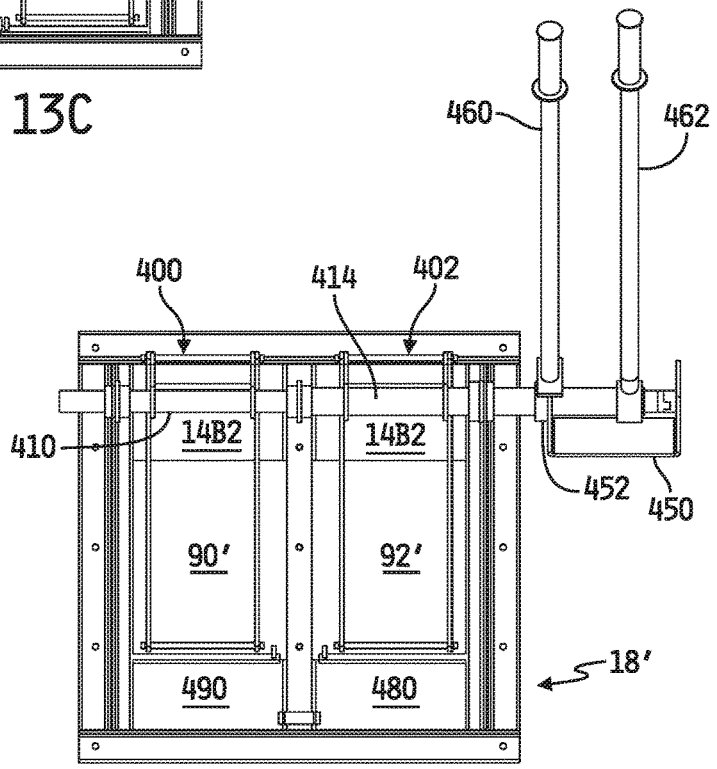
FIG. 13D is an assembled view of the lower door assembly of FIGS. 12-13C shown with both doors in a partially open position.

In one embodiment, as best illustrated in FIGS. 13A and 13D, the levers 460, 462 are illustratively mounted to the bracket 450 and shaft 414 respectively with sufficiently close proximity so as to allow simultaneous, single-handed actuation of both levers 460, 462 from a first position in which both doors 90', 92' are closed as illustrated by example in FIG. 13A, to a second position in which both doors 90', 92' are at least partially open as illustrated by example in FIG. 13D. Such close proximity of the levers 460, 462 illustratively facilitates dispensing of approximately a 50/50 mix of seeds from the bin 10' via such simultaneous, single-handed actuation of the levers 460, 462. However, the levers 460, 462 remain at all times independently controllable to selectively expose some portion or all of the openings 60, 62 respectively.

Although not specifically illustrated in FIGS. 12-13D, it will be understood that one or more of the plates 82A', 420, 430, 440, 82C' and/or either door 90', 92' may be marked with a number of vertically spaced-apart, horizontally-extending marks, such as the marks 140 illustrated in FIGS. 5-6C, to provide a visual guide for setting a ratio of exposed cross-sectional areas of the openings 60, 62 via controlled raising of the doors 90', 92'. The exposed cross-sectional areas 490, 480 of the openings 60, 62 respectively define the flow rate of seeds exiting each of the separate, vertically aligned spaces 46, 56 and 48, 58 of the walled container 14. Independent control of the exposed cross-sectional areas of the openings 60, 62 via selective actuation of the doors 90', 92' respectively thus provides for the ability to control a mix ratio of seeds exiting the walled container 14. It will be understood that alternate embodiments of the walled container 14 and the door assembly 18 and/or 18' are contemplated which include more partitioned spaces and corresponding numbers of lower doors as just described to provide for the storage, dispensing, and potential mixing, of any number of different or like seed types or varieties. Those skilled in the art will recognize that it would be a mere mechanical step to extend the concepts illustrated and described herein to such variants. It will also be understood that the structure and operation of the door assemblies 18 and 18' represents illustrative example embodiments thereof, and that this disclosure contemplates other embodiments of one or more mechanisms for selectively closing and exposing part or all of the openings 60, 62, examples of which may include, but are not limited to, structures/mechanisms configured to slide, pivot, rotate, linearly translate and/or otherwise move relative to either or both of the openings 60, 62 under mechanical, electromechanical, fluid and/or other conventionally applied force.

Figure 14:
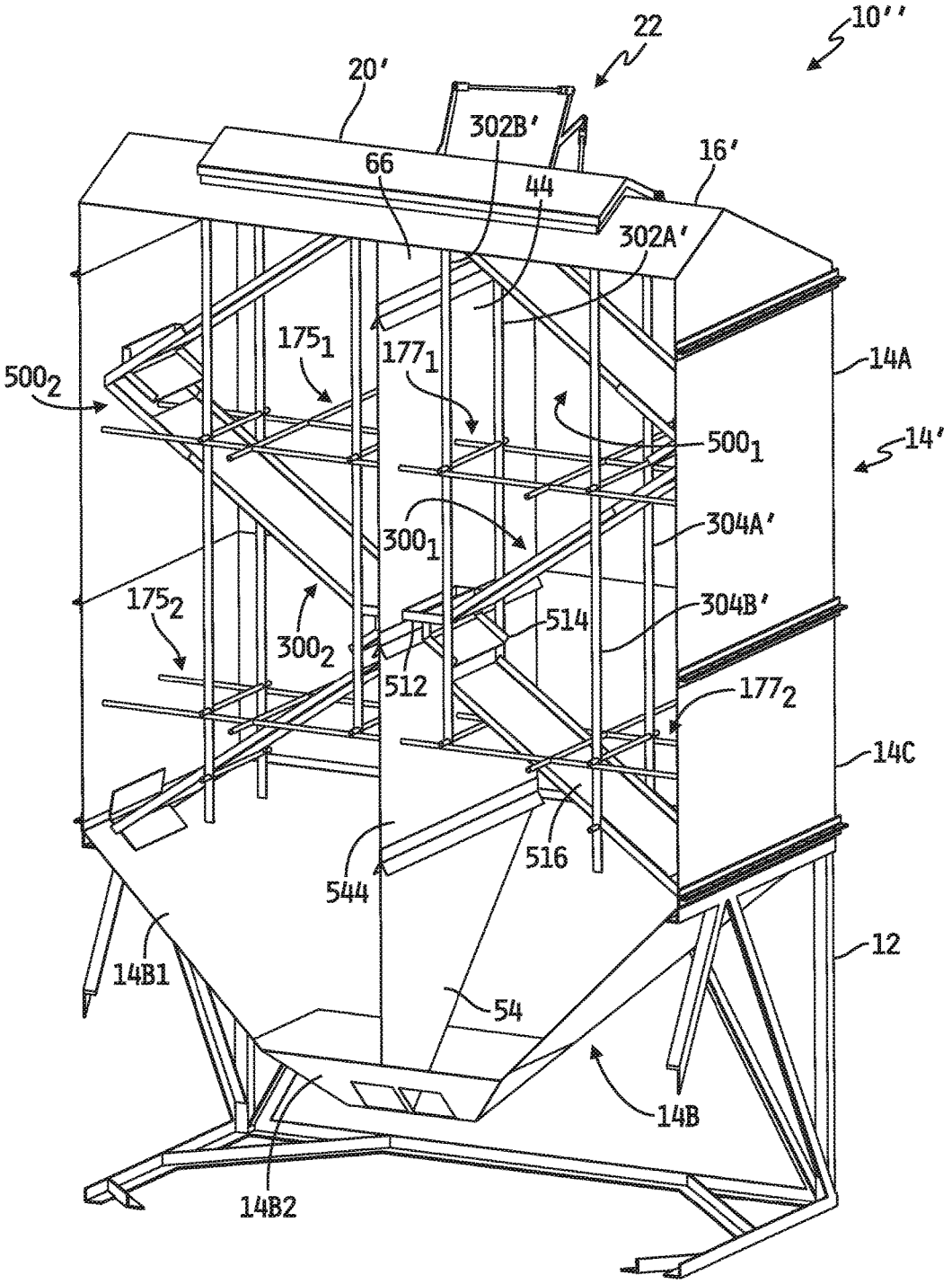
FIG. 14 is a cross-sectional view of yet another embodiment of a seed storage and dispensing bin as viewed along the same perspective as that illustrated in FIG. 10.

Referring now to FIG. 14, yet another embodiment of a seed storage and dispensing bin 10" is shown. The seed storage and dispensing bin 10" is substantially larger than the seed storage and dispensing bins 10, 10' described above in terms of the total or maximum volume of seeds storable therein. As such, while the seed storage and dispensing bin 10" may be transported to a desired location and/or from one location to another, e.g., when empty, and/or assembled, partially or wholly, in the field, it is primarily intended for more long-term implementation and installation in or at a single location. In any case, the seed storage and dispensing bin 10" is, also like the seed storage and dispensing bins 10, 10' described above, configured to receive, store therein and selectively dispense one or more types or varieties of seeds.

The seed storage and dispensing bin 10" illustrated in FIG. 14 is identical in many respects to the seed storage and dispensing bin 10' illustrated in FIGS. 9-13D and described above, and like numbers are therefore used to identify like components. In one aspect, the seed storage and dispensing bin 10" differs from the seed storage and dispensing bin 10" in that the walled enclosure 14' includes a middle walled enclosure 14C disposed between the upper walled enclosure 14A and the lower walled enclosure 14B and including a divider 544 that is aligned with the dividers 44 and 54 when the walled enclosure 14C is mounted to and between the walled enclosures 14A, 14B. As a result of the additional walled enclosure 14C, modified seed slides $\mathbf{500}_1$ and $\mathbf{500}_2$ mounted therein each include additional seed slide structure appended to the lower ends of the seed slides $\mathbf{300}_1$, $\mathbf{300}_2$ respectively. It will be noted that in the embodiment illustrated in FIG. 14, the base seed slides $\mathbf{300}_1$, $\mathbf{300}_2$ are reversed in position within the walled enclosure 14' as compared with FIG. 10 to accommodate the additional seed slide structure described below. Additionally, the frame members 302A, 302B, 304A, 304B are replaced with longer frame members 302A', 302B', 304A', 304B' also to accommodate the additional seed slide structure.

In the embodiment illustrated in FIG. 14, the deflector plate 320 of the seed slide $\mathbf{300}_1$ is replaced with a bracket 512 and a deflector plate 514 each illustratively identical to the bracket 312 and deflector plate 314 illustrated in FIG. 11 and described above, and another seed slide 516 is mounted to the frame members 302A', 302B', 304A', 304B' below the lower seed slide 316, wherein the additional seed slide 516 is illustratively identical to the lower seed slide 316 except that it is reversed in direction such that it slopes downwardly away from the bottom end $\mathbf{316}_2$ of the seed slide 316. An additional deflector plate (not shown), illustratively identical to the deflector plate 322, is mounted to the seed slide 516 at or adjacent to the bottom end thereof as described above with respect to the deflector plate 322. The spacing between bottom end $\mathbf{316}_2$ of the seed slide 316 and the deflector plate 514, the spacing between the deflector plate 514 and the top end of the seed slide 516 and the spacing between the bottom of the seed slide 516 and the deflector plate mounted to the seed slide 516 at or adjacent to the bottom end thereof are illustratively $S_1$, $S_2$ and $S_3$ as described above, although it will be understood that other values of $S_1$, $S_2$ and/or $S_3$ may alternatively be used.

As also illustrated in FIG. 14, the bin 10" includes two support frames $\mathbf{177}_1$, $\mathbf{177}_2$ mounted one above the other, wherein each is illustratively identical to the support frame 177 illustrated in FIG. 10. Each support frame $\mathbf{177}_1$, $\mathbf{177}_2$ is illustratively positioned and configured to support the frame members 302A', 302B', 304A', 304B' as described above with respect to the support frame 177. The seed slide $\mathbf{500}_2$ is illustratively a mirror image of the seed slide $\mathbf{500}_1$ just described, and is supported by two support frames $\mathbf{175}_1$, $\mathbf{175}_2$ which are illustratively identical in structure and operation to the support frame 175 illustrated in FIG. 10 and described above. The seed slides $\mathbf{500}_1$, $\mathbf{500}_2$ are illustratively identical in operation to the seed slides $\mathbf{300}_1$, $\mathbf{300}_2$ described above except that the seed slides $\mathbf{500}_1$, $\mathbf{500}_2$ each provide for an addition re-direction and transport of seeds via the additional lower seed slide 516.

In one example implementation of the seed storage and dispensing bin 10" illustrated in FIG. 14, which should not be considered to be limiting in any way, the frame 12, the lower walled enclosure 14B, the upper walled enclosure 14A and the roof 16' are all illustratively dimensioned as described above with respect to the seed storage and dispensing bin 10. The additional middle walled enclosure 14C is illustratively 48 inches in height and is otherwise dimensioned consistently with the upper and lower walled enclosures 14A, 14B respectively, such that the total height of the seed storage and dispensing bin 10" is approximately 233.625 inches in height. Those skilled in the art will recognize other dimensions that may be used in the implementation of any one or more of the components of the seed storage and dispensing bin 10" just described, and it will be understood that that any such other dimension(s) of any such component(s) is/are contemplated by this disclosure While the disclosure has been illustrated and described in detail in the drawings and foregoing description, such an illustration and description is to be considered as exemplary and not restrictive in character, it being understood that only illustrative embodiments have been shown and described and that all changes and modifications consistent with the disclosure and recited claims are desired to be protected. For example, while embodiments have been illustrated and described herein as including two separate seed storage spaces, it will be understood that this disclosure contemplates embodiments which include three or more seed storage spaces or which include only a single seed storage space. Those skilled in the art will recognize that it would be a mere mechanical step to extend the concepts illustrated and described herein to such variants. As another example, it will be understood that one or more components illustrated and described with respect to one embodiment may be implemented in another embodiment illustrated and described herein, and that any such combination is within the scope of this disclosure. As one specific example, embodiments of the seed storage and dispensing bin are contemplated which include the lower door assembly 18 illustrated in FIGS. 5-6C and either the seed slides $\mathbf{300}_1$ and $\mathbf{300}_2$ illustrated in FIGS. 9-11 or a combination of one of the seed slides $\mathbf{300}_1$, $\mathbf{300}_2$ and one of the seed ladders 76, 78 illustrated in FIGS. 3 and 8. As another specific example, other embodiments of the seed storage and dispensing bin are contemplated which include the lower door assembly 18' illustrated in FIGS. 12-13D and either the seed slides $\mathbf{300}_1$ and $\mathbf{300}_2$ illustrated in FIGS. 9-11 or a combination of one of the seed slides $\mathbf{300}_1$, $\mathbf{300}_2$ and one of the seed ladders 76, 78 illustrated in FIGS. 3 and 8. Other combinations will occur to those skilled in the art, and it will be understood that any such other combinations are intended to fall within the scope of this disclosure.

What is claimed is:

1. A seed storage and dispensing bin, comprising:

a walled container having a top, a bottom opposite the top, an interior space defined between the top and the bottom and a divider dividing the interior space into first and second separate spaces each sized to receive a plurality of seeds therein, a first opening defined in the bottom of the container and open to the first space, a second opening defined in the bottom of the container and open to the second space, a first plate slidably mounted to an exterior surface of the container over the first opening, a second plate slidably mounted to the exterior surface of the container over the second opening, means for incrementally sliding the first plate relative to the exterior surface of the container between closed and open positions thereof and between the open and closed positions thereof, wherein the first plate covers the first opening in the closed position thereof and the first plate exposes a first cross-sectional area of the first opening in the open position thereof, and means for incrementally sliding the second plate relative to the exterior surface of the container between closed and open positions thereof and between the open and closed positions thereof, wherein the second plate covers the second opening in the closed position thereof and the second plate exposes a first cross-sectional area of the second opening in the open position thereof.

2. The seed storage and dispensing bin of claim 1, wherein the walled container comprises:

a top walled enclosure having an open top, an open bottom opposite the open top, and defining a first portion of the interior space of the walled container between the open top and the open bottom thereof, and a bottom walled enclosure having an open top coupled to the open bottom of the top walled enclosure, a bottom opposite the open top of the bottom walled enclosure and defining therein the first and second openings of the walled container, the bottom walled enclosure defining a second portion of the interior space of the walled container between the open top and the bottom thereof, wherein the divider comprises a first divider positioned in the top walled enclosure and dividing the first portion of the interior space of the walled container into a first portion of the first space and a first portion of the second space, and a second divider positioned in the bottom walled enclosure and aligned with the first divider, the second divider dividing the second portion of the interior space of the walled container into a second portion of the first space aligned with the first portion of the first space and a second portion of the second space aligned with the first portion of the second space.

3. The seed storage and dispensing bin of claim 1, wherein the walled container comprises:

a top walled enclosure having an open top, an open bottom opposite the open top, and defining a first portion of the interior space of the walled container between the open top and the open bottom thereof, a middle walled enclosure having an open top coupled to the open bottom of the top walled enclosure, an open bottom opposite the open top of the middle walled enclosure and defining a second portion of the interior space of the walled container between the open top and the open bottom thereof, and a bottom walled enclosure having an open top coupled to the open bottom of the middle walled enclosure, a bottom opposite the open top of the bottom walled enclosure and defining therein the first and second openings of the walled container, the bottom walled enclosure defining a third portion of the interior space of the walled container between the open top and the bottom thereof, wherein the divider comprises a first divider positioned in the top walled enclosure and dividing the first portion of the interior space of the walled container into a first portion of the first space and a first portion of the second space, a second divider positioned in the middle walled enclosure and aligned with the first divider, the second divider dividing the second portion of the interior space of the walled container into a second portion of the first space aligned with the first portion of the first space and a second portion of the second space aligned with the first portion of the second space, and a third divider positioned in the bottom walled enclosure and aligned with the first and second dividers, the third divider dividing the third portion of the interior space of the walled container into a third portion of the first space aligned with the first and second portions of the first space and a third portion of the second space aligned with the first and second portions of the second space.

4. The seed storage and dispensing bin of claim 1, further comprising a frame configured to be supported on a support surface, the frame receiving therein the bottom of the walled container with the bottom of the walled container suspended above the support surface.

5. The seed storage and dispensing bin of claim 4, wherein the frame has an open top and a bottom opposite the open top, the bottom of the frame configured to rest on the support surface, and wherein a bottom walled enclosure of the walled container includes a first flange surrounding and extending outwardly away from an open top thereof, and wherein the bottom walled enclosure is received within the frame with the bottom walled enclosure supported along the open top of the frame by the first flange.

6. The seed storage and dispensing bin of claim 5, wherein a top walled enclosure of the walled container includes a second flange surrounding and extending outwardly away from an open bottom thereof, and wherein the top walled enclosure is coupled to the bottom walled enclosure with the second flange supported on the first flange.

7. The seed storage and dispensing bin of claim 5, wherein a middle walled enclosure of the walled container includes a second flange surrounding and extending outwardly away from an open bottom thereof and a third flange surrounding and extending outwardly away from an open top thereof, the middle walled enclosure coupled to the bottom walled enclosure with the second flange supported on the first flange, and wherein a top walled enclosure of the walled container includes a fourth flange surrounding and extending outwardly from an open bottom thereof, the top walled enclosure coupled to the middle walled enclosure with the fourth flange supported on the third flange.

8. The seed storage and dispensing bin of claim 1, wherein the top of the walled container is an open top, the seed storage bin further comprising:

a roof having an open bottom coupled to the open top of the walled container and a top opposite the open bottom thereof, a first opening defined through the top of the roof and open to the first space, a second opening defined through the bottom of the roof and open to the second space, at least one door mounted to the roof over the first and second openings thereof, and means for moving the at least one door between a closed position in which the at least one door completely covers the first and second openings defined through the top of the roof and an open position in which the first and second openings defined through the top of the roof are exposed.

9. The seed storage and dispensing bin of claim 1, further comprising:

a first seed slide assembly positioned in the first space of the walled container via which seeds released into the top of the walled container slide in the first space of the walled container, and a second seed slide assembly positioned in the second space of the walled container via which seeds released into the top of the walled container slide in the second space of the walled container.

10. A seed storage and dispensing bin, comprising:

a walled container having a top, a bottom opposite the top, and an interior space defined between the top and the bottom and sized to receive a plurality of seeds therein, a roof having an open bottom and a top opposite the open bottom thereof, the bottom of the roof coupled to the top of the walled container and the top of the roof defining an opening therethrough, and a seed slide assembly positioned in the interior space of the walled container and coupled at a top end thereof to the roof at the opening defined through the roof, the seed slide assembly having a bottom end, opposite the top end thereof, extending downwardly into the interior space of the walled container, the seed slide assembly including a first elongated seed slide sloping downwardly in a first direction into the interior space of the walled container and a second seed slide sloping downwardly in a second direction, different from the first direction, into the interior space of the walled container, the first seed slide positioned between the second seed slide and the opening defined through the roof with a top end of the second seed slide positioned below a bottom end of the first seed slide, wherein the first and second seed slides are configured such that seeds released into the opening in the top of the roof slide downwardly on the first seed slide and onto the second seed slide, and then slide downwardly on the second seed slide and in the interior space of the walled container;

wherein the seed slide assembly further comprises a first deflector plate positioned adjacent to the bottom end of the first seed slide, the first deflector plate configured to direct seeds exiting the first seed slide onto the second seed slide.

11. The seed storage and dispensing bin of claim 10, further comprising an energy-absorbing member mounted to the first seed slide to absorb energy resulting from impact of seeds with the first seed slide.

12. The seed storage and dispensing bin of claim 10, wherein the seed slide assembly further comprises a second deflector plate positioned adjacent to a bottom end of the second seed slide, the second deflector plate configured to direct seeds exiting the first seed slide centrally into the interior space of the walled container.

13. The seed storage and dispensing bin of claim 12, wherein the first deflector plate comprises an upper plate spaced apart from and facing the bottom end of the first seed slide, and a lower plate above and spaced apart from the second seed slide, the upper and lower plates of the first detector plate defining a first angle therebetween, and wherein the second deflector plate comprises an upper plate spaced apart from and facing a bottom end of the second seed slide, and a lower plate, the upper and lower plates of the second detector plate defining a second angle therebetween.

14. A seed storage and dispensing bin, comprising:

a walled container having a top, a bottom opposite the top, an interior space defined between the top and the bottom and a divider dividing the interior space into first and second separate spaces each sized to receive a plurality of seeds therein, a first opening defined in the bottom of the container and open to the first space, a second opening defined in the bottom of the container and open to the second space, a first plate slidably mounted to an exterior surface of the container over the first opening, a second plate slidably mounted to the exterior surface of the container over the second opening, a first actuator configured to incrementally slide the first plate relative to the exterior surface of the container between closed and fully open positions thereof and between the fully open and closed positions thereof, wherein the first plate completely covers the first opening in the closed position thereof and the first plate exposes a first cross-sectional area of the first opening in the fully open position thereof, and a second actuator configured to incrementally slide the second plate relative to the exterior surface of the container between a closed and fully open positions thereof and between the fully open and closed positions thereof, wherein the second plate completely covers the second opening in the closed position thereof and the second plate exposes a first cross-sectional area of the second opening in the fully open position thereof, whereby the first and second actuators are selectively actuatable to expose the same or different cross-sectional areas of the first and second openings respectively;

wherein the first actuator comprises:

a first bracket assembly mounted to the first plate, a first rotatable shaft coupled to the first bracket assembly, and a first lever mounted to the first rotatable shaft, wherein actuation of the first lever in a first direction relative to the walled container causes the first rotatable shaft to drive the first bracket assembly and the first plate coupled thereto upwardly toward the fully open position of the first plate, and wherein actuation of the first lever in a second direction opposite the first direction causes the first rotatable shaft to drive the first bracket assembly and the first plate coupled thereto downwardly toward the closed position of the first plate, wherein the second actuator comprises:

a second bracket assembly mounted to the second plate, a second rotatable shaft coupled to the second bracket assembly, and a second lever mounted to the second rotatable shaft, wherein actuation of the second lever in a first direction relative to the walled container causes the second rotatable shaft to drive the second bracket assembly and the second plate coupled thereto upwardly toward the fully open position of the second plate, and wherein actuation of the second lever in a second direction opposite the first direction thereof causes the second rotatable shaft to drive the second bracket assembly and the second plate coupled thereto downwardly toward the closed position of the second plate.

15. The seed storage and dispensing bin of claim 14, further comprising at least one visual indicator operatively positioned relative to one of the first plate and the first opening and relative to one of the second plate and the second opening, the at least one visual indicator cooperating with the one of the first plate and the first opening and with the one of the second plate and the second opening to provide a visual indication of a ratio of the exposed cross-sectional areas of the first and second openings defined by selective sliding of the first and second plates respectively relative to the first and second openings respectively.

16. The seed storage and dispensing bin of claim 14, wherein the first and second levers are positioned sufficiently close to each other to allow simultaneous, single-person actuation of the first and second levers between their respective first and second positions.

* * * * *